US008408844B2

(12) United States Patent
Tanaka et al.

(10) Patent No.: US 8,408,844 B2
(45) Date of Patent: Apr. 2, 2013

(54) STEEL MATERIAL FOR UNDERGROUND CONTINUOUS WALL, METHOD FOR PRODUCING STEEL MATERIAL FOR UNDERGROUND CONTINUOUS WALL, UNDERGROUND CONTINUOUS WALL, AND METHOD FOR CONSTRUCTING UNDERGROUND CONTINUOUS WALL

(75) Inventors: Ryuuta Tanaka, Tokyo (JP); Tatsuaki Kurosawa, Tokyo (JP); Shinji Taenaka, Tokyo (JP); Masataka Tatsuta, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 234 days.

(21) Appl. No.: 12/438,079

(22) PCT Filed: Sep. 5, 2007

(86) PCT No.: PCT/JP2007/067290

§ 371 (c)(1),
(2), (4) Date: Feb. 19, 2009

(87) PCT Pub. No.: WO2008/029835

PCT Pub. Date: Mar. 13, 2008

(65) Prior Publication Data

US 2010/0166508 A1 Jul. 1, 2010

(30) Foreign Application Priority Data

Sep. 5, 2006 (JP) ..... 2006 240654

(51) Int. Cl.
*E02D 5/04* (2006.01)

(52) U.S. Cl. ..... 405/276; 405/277; 405/278; 405/284

(58) Field of Classification Search ..... 405/274, 405/276, 277, 278, 284, 285
See application file for complete search history.

(56) References Cited

U.S. PATENT DOCUMENTS

2004/0101370 A1* 5/2004 Nishiumi et al. ..... 405/276

FOREIGN PATENT DOCUMENTS

| | | | |
|---|---|---|---|
| EP | 000315548 | * | 5/1989 |
| JP | 55-68918 | A | 5/1980 |
| JP | 58-140233 | U | 9/1983 |

(Continued)

OTHER PUBLICATIONS http://www.merriam-webster.com/dictionary/juxtaposition.*

(Continued)

*Primary Examiner* — Sean Andrish
(74) *Attorney, Agent, or Firm* — Birch, Stewart, Kolasch & Birch, LLP

(57) ABSTRACT

A steel material for an underground continuous wall equipped with a hat type steel sheet pile having a hat-shaped cross-section, and an H-beam having an H-shaped cross-section, wherein: the hat type steel sheet pile includes a web, a pair of flanges, and a pair of arm sections; the H-beam includes a pair of flange sections and a web section; an outer surface of the H-beam is secured to an outer surface of the web; the length of the H-beam is shorter than that of the hat type steel sheet pile, and an overall length of the H-beam is arranged within the length of the hat type steel sheet pile; and a rear end of the H-beam is located closer to a forward end side than a rear end of the hat type steel sheet pile.

11 Claims, 13 Drawing Sheets

FOREIGN PATENT DOCUMENTS

| | | | | |
|---|---|---|---|---|
| JP | 60-186343 | U | | 12/1985 |
| JP | 361028616 | | * | 2/1986 |
| JP | 62-133209 | A | | 6/1987 |
| JP | 5-140928 | A | | 6/1993 |
| JP | 6-280251 | A | | 10/1994 |
| JP | 11-140864 | A | | 5/1999 |
| JP | 2000-144718 | A | | 5/2000 |
| JP | 2002-212943 | A | | 7/2002 |
| JP | 2003-342948 | A | | 12/2003 |
| JP | 3603793 | B2 | | 10/2004 |
| JP | 2005-127033 | A | | 5/2005 |
| JP | 2005-171488 | A | | 6/2005 |
| JP | 2005-299202 | A | | 10/2005 |
| JP | 205299202 | | * | 10/2005 |
| JP | 2006-241816 | A | | 9/2006 |

OTHER PUBLICATIONS

Computer-generated English translation of JP 11-140864 A.
Computer-generated English translation of JP 2000-144718 A.
Computer-generated English translation of JPp 2005-127033 A.
Computer-generated English translation of JP 2005-171488 A.
Computer-generated English translation of JP 2005-299202 A.
Computer-generated English translation of JP 2006-241816 A.
Computer-generated English translation of JP 6-280251 A.
Partial English translation of JP 55-68918.
Partial English translation of JP 62-133209 A.
Notice of Reasons for Rejection for Japanese Patent Application No. 2008-533182, mailed on Aug. 23, 2011.
Road Earthworks—Temporary Structures Guideline, The Japan Road Association, Aug. 10, 2006, Revised Edition, 15th Printing, pp. 64, 97-99, FIG.2-9-30.

* cited by examiner

STEEL MATERIAL FOR UNDERGROUND CONTINUOUS WALL, METHOD FOR PRODUCING STEEL MATERIAL FOR UNDERGROUND CONTINUOUS WALL, UNDERGROUND CONTINUOUS WALL, AND METHOD FOR CONSTRUCTING UNDERGROUND CONTINUOUS WALL

CROSS-REFERENCE TO RELATED APPLICATIONS

This application is a PCT International Application No. PCT/JP2007/067290 filed on Sep. 5, 2007, which designated the United States, and on which priority is claimed under 35 U.S.C. §120. This application also claims priority under 35 U.S.C. §119(a) on Patent Application No. 2006-240654 filed in Japan on Sep. 5, 2006, all of which are expressly hereby incorporated by reference into the present application.

TECHNICAL FIELD

The present invention relates to a steel material for an underground continuous wall, a method for producing a steel material for an underground continuous wall, an underground continuous wall constructed from the steel material for an underground continuous wall, and a method for constructing an underground continuous wall from the material for an underground continuous wall which are widely used in the construction of retaining walls and bulkhead walls in construction and civil engineering projects. Priority is claimed on Japanese Patent Application No. 2006-240654, filed Sep. 5, 2006, the contents of which are incorporated herein by reference.

BACKGROUND ART

Conventionally, known types of steel materials for an underground continuous wall compositely integrated by combining steel sheet pile and H-beams, used when constructing a retaining wall or underground continuous wall (composite sheet pile) include (1) steel materials for an underground continuous wall in which a linear-shaped steel sheet pile or a wall-shaped steel sheet pile is secured to a flange of the H-beam by welding (for example refer to patent document 1).

Furthermore, in a known type of steel material for an underground continuous wall which is more rigid than the steel material for an underground continuous wall of (1) above, a U-shaped steel sheet pile is combined with H-beams, I-steel sections, or T-steel sections (for example refer to patent documents 3 through 6).

When constructing an underground continuous wall, because the underground continuous wall is constructed by linking a large number of the above-described steel sheet piles together in the horizontal direction, a large cost is incurred. If the length dimension of individual steel sheet piles in the steel material for an underground continuous wall can be reduced, in an underground continuous wall or retaining wall constructed using a large number of steel sheet piles, the weight of the steel material for the underground continuous wall is reduced, and accordingly transportation is easier. Furthermore, installation is also simplified, enabling the duration of construction work to be reduced. Consequently, an underground continuous wall can be constructed inexpensively, and construction costs can be reduced, providing a significant effect. For this reason, a lightweight and inexpensive steel material for an underground continuous wall is desired.

In the case where the H-beam is secured into a channel of a U-shaped steel sheet pile, because the H-beam is secured to the inside surface of the U-shaped steel sheet pile where the flanges are inclined at a greater angle, when the wall is driven into the ground, a problem occurs whereby the earth inside the channel in the U-shaped steel sheet pile tends to become compacted, causing the channel to become blocked. In contrast, the combination of a hat type steel sheet pile and an H-beam forms a gentler angle of incline than the U-shaped steel sheet pile, providing an advantage whereby the compaction of earth is reduced, alleviating the problem described above.

However, with a hat type steel sheet pile 2 manufactured by rolling such as that shown in FIG. 10, if its dimensions are changed, large equipment costs are incurred at the rolling facility. Existing hat type steel sheet piles include the hat type steel sheet piles 2 of the dimensions (in mm) shown in FIG. 10 and FIG. 11. In these hat type steel sheet piles 2, flanges 5 inclined so as to spread outward, are connected integrally to each end of a web 7, and arm sections 3 and 4 running parallel to the web 7 are connected integrally to the respective flanges 5, and at the ends of the arm sections 3 and 4, joints 14 (14*a* and 14*b*) are integrally formed, giving a hat shape in cross-section. The left and right joints 14*a* and 14*b* are point-symmetric with respect to the center point of the central axis of the arm sections 3 and 4, such that when the joints 14*a* and 14*b* of adjacent hat type steel sheet piles 2 are fitted together, the hat type steel sheet piles 2 can be arranged upon the central axis of the arms.

An advantage of the hat type steel sheet pile 2 is that because the hat type steel sheet pile 2 includes the inclined flanges 5 and the arm sections 3 and 4 at both ends thereof, the wide width dimension of the sheet pile means that fewer sheet piles need to be driven, allowing an inexpensive wall to be constructed. On the other hand, there has been a problem in that a hat type steel sheet pile with high flexural rigidity cannot be manufactured inexpensively and easily without changing the width dimension of the sheet pile.

Patent document 1: Japanese Unexamined Patent Application, First Publication No. S62-133209

Patent document 2: Japanese Unexamined Patent Application, First Publication No. H11-140864

Patent document 3: Japanese Unexamined Patent Application, First Publication No. S55-68918

Patent document 4: Japanese Unexamined Patent Application, First Publication No. H06-280251

Patent document 5: Japanese Unexamined Patent Application, First Publication No. 2005-127033

Patent document 6: Japanese Patent No. 3603793

DETAILED DESCRIPTION OF THE INVENTION

Problems to be Solved by the Invention

In the abovementioned background art, although the combining of U-shaped steel sheet piles and H-beams is disclosed, no disclosure is made that clarifies in specific terms the relationship of the length dimension of the H-beam with respect to the U-shaped steel sheet pile, in order to provide a more economical steel material for an underground continuous wall.

Furthermore, a problem arises in that a hat type steel sheet pile with high flexural rigidity cannot be manufactured inexpensively and easily without changing the width dimension of the sheet pile. Therefore a more rigid inexpensive steel material for an underground continuous wall is desired which uses a hat type sheet steel pile in production today or in the future.

An object of the present invention is to provide a steel material for an underground continuous wall which exploits the advantages of the hat type steel sheet pile 2 and further incorporates an H-beam, wherein the length dimension of the H-beam with respect to the U-shaped steel sheet pile is defined in specific terms, to provide a lower cost yet practical steel material for an underground continuous wall. In other words, an object of the present invention is to provide a steel material for an underground continuous wall which can construct a practical retaining wall or underground continuous wall at a lower cost.

Means for Solving the Problems

The inventors of the present invention focused on the fact that when constructing an underground continuous wall or retaining wall using a steel material for an underground continuous wall which incorporates an H-beam into the hat type steel sheet pile, there is no rational reason why the steel material for an underground continuous wall must have the same cross-section along the entire vertical length. In addition, the inventors of the present invention considered that if crown displacement of the retaining wall can be suppressed to a displacement that results in no practical issues, an even less expensive steel material for an underground continuous wall is obtained, and by using such a steel material for an underground continuous wall, a less expensive underground continuous wall or retaining wall can be constructed, thereby completing the present invention.

In order to solve the above problems, the present invention adopts the following configuration.

A first aspect of the present invention is a steel material for an underground continuous wall equipped with a hat type steel sheet pile having a hat-shaped vertical cross-section with respect to the length direction thereof, and an H-beam having an H-shaped vertical cross-section with respect to the length direction thereof, wherein: the hat type steel sheet pile includes a web, a pair of flanges connected integrally to each end of the web and inclined so as to spread outward, and a pair of arm sections substantially parallel to the web which are each connected integrally to one of the pair of flanges; the H-beam includes a pair of flange sections substantially parallel to each other, and a web section which connects the pair of flange sections to each other leaving space therebetween; an outer surface on an opposite side to a surface of one of the pair of flanges of the H-beam which connects to the web section is secured to an outer surface of the web, the outer surface being on an opposite side to a channel formed by the web and the flanges of the hat type steel sheet pile; a dimension of the H-beam in the length direction is shorter than a dimension of the hat type steel sheet pile in the length direction; and an overall length of the H-beam in the length direction is arranged within the dimension of the hat type steel sheet pile in the length direction, and a rear end of the H-beam is located closer to a forward end side in the length direction than a rear end of the hat type steel sheet pile.

Moreover, as described below, in the present invention, when driving the steel material for an underground continuous wall into the ground to construct a retaining wall or bulkhead wall or the like, the side serving as the top end of the steel material for an underground continuous wall when the retaining wall or bulkhead wall or the like is in the constructed state is clamped by a driving machine (including a clamp (clamping section) and a vibratory device), and with the bottom end side of the steel material for an underground continuous wall as the leading end and the top end side of the steel material for an underground continuous wall as the tailing end, the steel material for an underground continuous wall is driven into the ground. Accordingly, in the present invention, the forward end of the steel material for an underground continuous wall forms the bottom end of the constructed retaining wall or bulkhead wall or the like when a retaining wall or bulkhead wall or the like is constructed from the steel material for an underground continuous wall, and the rear end of the steel material for an underground continuous wall forms the top end when a retaining wall or bulkhead wall or the like is constructed from the steel material for an underground continuous wall.

According to the first aspect of the steel material for an underground continuous wall, because the dimension of the H-beam in the length direction is shorter than the dimension of the hat type steel sheet pile in the length direction, an inexpensive and lightweight steel material for an underground continuous wall can be obtained. When this steel material for an underground continuous wall is used, an economical retaining wall or bulkhead wall or the like can be constructed.

Furthermore, when the rear end section of the steel material for an underground continuous wall is clamped by the driving machine, with a steel material for an underground continuous wall in which the position of the rear end of the hat type steel sheet pile coincides with the position of the rear end of the H-beam in the length direction, the hat type steel sheet pile and the H-beam are both present at the rear end of the steel material for an underground continuous wall which the driving machine attempts to clamp, and the clamping of the steel material for an underground continuous wall by the driving machine is particularly difficult. In contrast, with the first aspect of the invention, because the rear end of the H-beam is located closer to the forward end side in the length direction than the rear end of the hat type steel sheet pile, only the hat type steel sheet pile is present at the rear end of the steel material for an underground continuous wall. For this reason, the driving machine can easily clamp the rear end section of the steel material for an underground continuous wall. For example, when only the rear end section of the hat type steel sheet pile is clamped, clamping can be performed easily without interference from the H-beam.

In the construction of some underground continuous walls, a steel material for an underground continuous wall in which a hat type steel sheet pile and an H-beam are integrated, and a steel material for an underground continuous wall composed of only a hat type steel sheet pile, may be connected to each other in an alternating manner along the horizontal direction. As the steel material for an underground continuous wall in which a hat type steel sheet pile and an H-beam are integrated, if a steel material is used in which the position of the rear end of the hat type steel sheet pile coincides with the position of the rear end of the H-beam in the length direction, a special driving machine must be used to drive this steel material for an underground continuous wall into the ground. For this reason, a need arises to perform the driving work by using both the special driving machine, and the driving machine normally used to drive the steel material for an underground continuous wall composed only of the hat type steel sheet pile, in an alternating manner, which complicates the work immensely. In contrast, with the first aspect of the present invention, the rear end section of the hat type steel sheet pile can be clamped without interference from the H-beam. For this reason, the task of installing both steel materials can be performed using only the driving machine normally used to drive the hat type steel sheet pile, which simplifies the driving work.

In the steel material for an underground continuous wall according to the first aspect, a position of a forward end of the hat type steel sheet pile may coincide with a position of a forward end of the H-beam in the length direction. In this case, the effects described for the first aspect of the steel material for an underground continuous wall are obtained in the same manner.

A separation length between the rear end of the hat type steel sheet pile and the rear end of the H-beam may be not more than 50% of a wall height from a planned ground level to a ground surface in a retaining wall constructed from the steel material for an underground continuous wall.

When the steel material for an underground continuous wall is used as the steel material in a retaining wall on which the earth pressure acts from one side, even if the earth pressure acts to displace the crown of the retaining wall in the earth pressure acting direction, the displacement can be suppressed to not more than a 10% increase from the crown displacement Y (that is, not more than 110% of the crown displacement Y) designated by design for when a steel material for an underground continuous wall which includes a hat type steel sheet pile and an H-beam of equal lengths welded together along the entire length thereof is used. As a result, a steel material for an underground continuous wall which is sufficiently rigid, as well as inexpensive and lightweight can be obtained.

Furthermore, as described in the experimental results below, it is apparent that if the separation length between the rear end of the hat type steel sheet pile and the rear end of the H-beam exceeds 50% of the wall height from the planned ground level to the ground surface in a retaining wall constructed from the steel material for an underground continuous wall, crown displacement increases rapidly. In contrast, if the separation length between the rear end of the hat type steel sheet pile and the rear end of the H-beam is not more than 50% of the wall height from the planned ground level to the ground surface in a retaining wall constructed from the steel material for an underground continuous wall, the rate of increase of crown displacement is kept low. In this manner, when the separation length is not more than 50% of the wall height, compared to a case where the separation length exceeds 50% of the wall height, the steel material for an underground continuous wall is sufficiently rigid, and is also inexpensive and lightweight.

A separation length between the rear end of the hat type steel sheet pile and the rear end of the H-beam may be not less than 10% and not more than 50% of a wall height from a planned ground level to a ground surface in the retaining wall constructed from the steel material for an underground continuous wall.

In this case, when the steel material for an underground continuous wall is used as the steel material in a retaining wall on which the earth pressure acts from one side, even if the earth pressure acts to displace the crown of the retaining wall in the earth pressure acting direction, the displacement can be suppressed to not more than a 10% increase from the crown displacement Y (that is, not more than 110% of the crown displacement Y) designated by design for when a steel material for an underground continuous wall which includes a hat type steel sheet pile and an H-beam of equal lengths welded together along the entire length thereof is used. As a result, a steel material for an underground continuous wall which is sufficiently rigid can be obtained. Furthermore, because the separation length is not less than 10% of the wall height, the economic benefits are great, enabling an inexpensive and lightweight steel material for an underground continuous wall to be obtained.

A separation length between the rear end of the hat type steel sheet pile and the rear end of the H-beam may be not more than 30% of a wall height from a planned ground level to a ground surface in a retaining wall constructed from the steel material for an underground continuous wall.

In this case, as is apparent from the experimental results given below, substantially the same crown displacement can be maintained as when a steel material for an underground continuous wall which includes a hat type steel sheet pile and an H-beam of equal lengths welded together along the entire length thereof is used. As a result a steel material for an underground continuous wall which is sufficiently rigid can be obtained.

A forward end of the H-beam may be located closer to a rear end side than a forward end of the hat type steel sheet pile in the length direction.

In this case, as is apparent from the experimental results given below, compared to configurations in which only the forward end of the H-beam is located closer to the rear end side than the forward end of the hat type steel sheet pile, and configurations in which only the rear end of the H-beam is located closer to the forward end side than the rear end of the hat type steel sheet pile, even though the cut length of the H-beam (the sum of the cut length of the forward end of the H-beam and the cut length of the rear end of the H-beam) is increased, an acceptable level of rigidity can be maintained. Accordingly, compared to the two configurations mentioned above, costs can be further reduced, and workability can be improved due to the lighter weight.

A separation length between the rear end of the hat type steel sheet pile and the rear end of the H-beam may be not more than 50% of a wall height from a planned ground level to a ground surface in a retaining wall constructed from the steel material for an underground continuous wall; and a separation length between the forward end of the hat type steel sheet pile and the forward end of the H-beam may be not more than 30% of an overall length of the steel material for an underground continuous wall in the length direction.

In this case, as is apparent from the experimental results given below, when the steel material for an underground continuous wall is used as the steel material in a retaining wall on which the earth pressure acts from one side, even if the earth pressure acts to displace the crown of the retaining wall in the earth pressure acting direction, the displacement can be suppressed to not more than a 10% increase from the crown displacement Y (that is, not more than 110% of the crown displacement Y) designated by design for when a steel material for an underground continuous wall which includes a hat type steel sheet pile and an H-beam of equal lengths welded together along the entire length thereof is used. As a result, a steel material for an underground continuous wall which is sufficiently rigid, as well as inexpensive and lightweight can be obtained.

Furthermore, as described in the experimental results below, it is apparent that if the separation length between the rear end of the hat type steel sheet pile and the rear end of the H-beam exceeds 50% of the wall height from the planned ground level to the ground surface in a retaining wall constructed from the steel material for an underground continuous wall, and the separation length between the forward end of the hat type steel sheet pile and the forward end of the H-beam exceeds 30% of the overall length of the steel material for an underground continuous wall in the length direction, crown displacement increases rapidly. In contrast, if the separation length between the rear end of the hat type steel sheet pile and the rear end of the H-beam is not more than 50% of the wall height from the planned ground level to the ground surface in the retaining wall constructed from the steel material for an underground continuous wall, and the separation length between the forward end of the hat type steel sheet pile and the forward end of the H-beam is not more than 30% of the overall length of the steel material for an underground continuous wall in the length direction, the rate of increase of crown displacement is kept low. In this manner, compared to other cases, the steel material for an underground continuous wall has sufficient rigidity, and is inexpensive and lightweight.

A separation length between the rear end of the hat type steel sheet pile and the rear end of the H-beam may be not less than 10% and not more than 50% of a wall height from a planned ground level to a ground surface in a retaining wall constructed from the steel material for an underground continuous wall; and a separation length between the forward end of the hat type steel sheet pile and the forward end of the H-beam may be not less than 5% and not more than 30% of the overall length of the steel material for an underground continuous wall in the length direction.

In this case, because the separation length between the rear end of the hat type steel sheet pile and the rear end of the H-beam is not more than 50% of the wall height, and the separation length between the forward end of the hat type steel sheet pile and the forward end of the H-beam is not more than 30% of the overall length, when the steel material for an underground continuous wall is used as the steel material in a retaining wall on which the earth pressure acts from one side, even if the earth pressure acts to displace the crown of the retaining wall in the earth pressure acting direction, the displacement can be suppressed to not more than a 10% increase from the crown displacement Y (that is, not more than 110% of the crown displacement Y) designated by design for when a steel material for an underground continuous wall which includes a hat type steel sheet pile and an H-beam of equal lengths welded together along the entire length thereof is used. As a result, a steel material for an underground continuous wall which is sufficiently rigid, as well as inexpensive and lightweight can be obtained. Furthermore, because the separation length between the rear end of the hat type steel sheet pile and the rear end of the H-beam is not less than 10%, and the separation length between the forward end of the hat type steel sheet pile and the forward end of the H-beam is not less than 5%, the economic benefits are great, enabling an inexpensive and lightweight steel material for an underground continuous wall to be obtained.

A separation length between the rear end of the hat type steel sheet pile and the rear end of the H-beam may be not less than 500 mm.

Normally, the length of the rear end section of the steel material for an underground continuous wall clamped by the driving machine is not more than 500 mm. Accordingly, the H-beam is not present in the area clamped by the driving machine, and the driving machine can easily clamp the rear end of the steel material for an underground continuous wall (the rear end section of the hat type steel sheet pile) to perform the driving work.

A second aspect of the present invention is a steel material for an underground continuous wall equipped with a hat type steel sheet pile having a hat-shaped vertical cross-section with respect to the length direction thereof, and an H-beam having an H-shaped vertical cross-section with respect to the length direction thereof, wherein: the hat type steel sheet pile includes a web, a pair of flanges connected integrally to each end of the web and inclined so as to spread outward, and a pair of arm sections substantially parallel to the web which are each connected integrally to one of the pair of flanges; the H-beam includes a pair of flange sections substantially parallel to each other, and a web section which connects the pair of flange sections to each other leaving space therebetween; an outer surface on an opposite side to a surface of one of the pair of flanges of the H-beam which connects to the web section is secured to an outer surface of the web, the outer surface being on an opposite side to a channel formed by the web and flanges of the hat type steel sheet pile; a dimension of the H-beam in the length direction is shorter than a dimension of the hat type steel sheet pile in the length direction, and an overall length of the H-beam in the length direction is arranged within the dimension of the hat type steel sheet pile in the length direction; a position of a rear end of the hat type steel sheet pile coincides with a position of a rear end of the H-beam in the length direction; a forward end of the H-beam is located closer to a rear end side in the length direction than a forward end of the hat type steel sheet pile; and a separation length between the forward end of the hat type steel sheet pile and the forward end of the H-beam is not more than 35% of an overall length of the steel material for the underground continuous wall in the length direction.

In the steel material for an underground continuous wall according to the second aspect of the present invention, as is apparent from the experimental results given below, when the steel material for an underground continuous wall is used as the steel material in a retaining wall on which the earth pressure acts from one side, even if the earth pressure acts to displace the crown of the retaining wall in the earth pressure acting direction, the displacement can be suppressed to not more than a 10% increase from the crown displacement Y (that is, not more than 110% of the crown displacement Y) designated by design for when a steel material for an underground continuous wall which includes a hat type steel sheet pile and an H-beam of equal lengths welded together along the entire length thereof is used. As a result, a steel material for an underground continuous wall which is sufficiently rigid, as well as inexpensive and lightweight can be obtained.

Furthermore, as described in the experimental results given below, it is apparent that if the separation length between the forward end of the hat type steel sheet pile and the forward end of the H-beam exceeds 35% of the overall length of the steel material for an underground continuous wall in the length direction, crown displacement increases rapidly. In contrast, if the separation length between the forward end of the hat type steel sheet pile and the forward end of the H-beam is not more than 35% of the overall length of the steel material for an underground continuous wall in the length direction, the rate of increase of crown displacement is kept low. In this manner, when the separation length is not more than 35% of the overall length, compared to when the separation length exceeds 35% of the overall length, the steel material for an underground continuous wall is sufficiently rigid, and is also inexpensive and lightweight.

In the second aspect of the steel material for an underground continuous wall of the present invention, the separation length between the forward end of the hat type steel sheet pile and the forward end of the H-beam may be not less than 5% of an overall length of the steel material for an underground continuous wall in the length direction.

In this case, the economic benefits are great, enabling an inexpensive and lightweight steel material for an underground continuous wall to be obtained.

The separation length between the forward end of the hat type steel sheet pile and the forward end of the H-beam may be not more than 20% of an overall length of the steel material for an underground continuous wall in the length direction.

In this case, as is apparent from the experimental results given below, substantially the same crown displacement can be maintained as when a steel material for an underground continuous wall is used which includes a hat type steel sheet pile and an H-beam of equal lengths welded together along the entire length. As a result, a steel material for an underground continuous wall which is sufficiently rigid can be obtained.

A first aspect of a method for producing a steel material for an underground continuous wall of the present invention includes: preparing a hat type steel sheet pile having a hat-shaped vertical cross-section with respect to the length direction thereof, and an H-beam having a H-shaped vertical cross-section with respect to the length direction thereof, in which the hat type steel sheet pile includes a web, a pair of flanges connected integrally to each end of the web and inclined so as to spread outward, and a pair of arm sections substantially parallel to the web which are each connected integrally to one of the pair of flanges, the H-beam includes a pair of flange sections substantially parallel to each other, and a web section which connects the pair of flange sections to each other leaving space therebetween, and a dimension of the H-beam in the length direction is shorter than a dimension of the hat type steel sheet pile in the length direction; arranging an overall length of the H-beam in the length direction within the dimension of the hat type steel sheet pile in the length direction, and in a condition with a rear end of the H-beam arranged so as to be positioned closer to a forward end side in the length direction than a rear end of the hat type steel sheet pile; contacting an outer surface on an opposite side to a surface of one of the pair of flange sections of the H-beam which connects to the web section, with an outer surface of the web, the outer surface being on the opposite side to a channel formed by the web and the flanges of the hat type steel sheet pile; and securing the web of the hat type steel sheet pile and the flange section of the H-beam which contact each other, to each other by welding.

According to the first aspect of a method for producing a steel material for an underground continuous wall of the present invention, an inexpensive and lightweight steel material for an underground continuous wall according to the first aspect of the present invention can be produced.

In the first aspect of a method for producing a steel material for an underground continuous wall of the present invention, a position of a forward end of the hat type steel sheet pile may be arranged so as to coincide with a position of a forward end of the H-beam in the length direction.

A forward end of the H-beam may be arranged so as to be positioned closer to a rear end side than a forward end of the hat type steel sheet pile in the length direction.

A second aspect of a method for producing a steel material for an underground continuous wall of the present invention includes: preparing a hat type steel sheet pile having a hat-shaped vertical cross-section with respect to the length direction thereof, and an H-beam having a H-shaped vertical cross-section with respect to the length direction thereof, in which the hat type steel sheet pile includes a web, a pair of flanges connected integrally to each end of the web and inclined so as to spread outward, and a pair of arm sections substantially parallel to the web which are each connected integrally to one of the pair of flanges, the H-beam includes a pair of flange sections substantially parallel to each other, and a web section which connects the pair of flange sections to each other leaving space therebetween, and a dimension of the H-beam in the length direction is shorter by not more than 35% of an overall length of the steel material for an underground continuous wall in the length direction, than a dimension of the hat type steel sheet pile in the length direction; arranging an overall length of the H-beam in the length direction within the dimension of the hat type steel sheet pile in the length direction, and coinciding a position of a rear end of the hat type steel sheet pile with a position of a rear end of the H-beam in the length direction, and in a condition with a forward end of the H-beam arranged so as to be positioned closer to a rear end side in the length direction than the forward end of the hat type steel sheet pile; contacting an outer surface on an opposite side to a surface of one of the pair of flange sections of the H-beam which connects to the web section, with an outer surface of the web, the outer surface being on an opposite side to a channel formed by the web and flanges of the hat type steel sheet pile; and securing the web of the hat type steel sheet pile and the flange section of the H-beam which contact each other, to each other by welding.

According to the second aspect of a method for producing a steel material for an underground continuous wall of the present invention, an inexpensive and lightweight steel material for an underground continuous wall according to the second aspect of the present invention can be produced.

In the second aspect of a method for producing a steel material for an underground continuous wall of the present invention, a dimension of the H-beam in the length direction may be shorter by not more than 20% of an overall length of the steel material for an underground continuous wall in the length direction, than a dimension of the hat type steel sheet pile in the length direction.

An underground continuous wall of the present invention is constructed using a plurality of steel materials for an underground continuous wall of the present invention.

A method for constructing an underground continuous wall of the present invention uses a plurality of steel materials for an underground continuous wall of the present invention.

Effects of the Invention

According to the present invention, an inexpensive and lightweight steel material for an underground continuous wall is obtained, and by using this steel material for an underground continuous wall, an economically favorable retaining wall or bulkhead wall can be constructed.

DESCRIPTION OF THE REFERENCE SYMBOLS

Figure 1A:
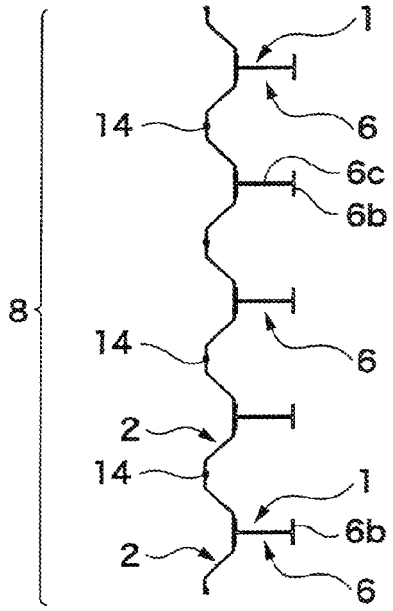
FIG. 1A is a plan view showing a state in which steel materials for an underground continuous wall according to the first through third aspects of the present invention are engaged in a parallel arrangement.

1 Steel material for an underground continuous wall, 2 Hat type steel sheet pile, 3 Arm section of hat type steel sheet pile, 4 Arm section of hat type steel sheet pie, 5 Flange of hat type steel sheet pile, 6 H-beam, 6*a* One flange of H-beam, 6*a*1 Joining surface of one flange of H-beam, 6*b* Other flange of H-beam, 6*c* Web section of H-beam, 7 Web of hat type steel sheet pile, 8 Retaining wall, 9 Ground surface, 10 Planned ground level, 11 Virtual ground level, 12*a*, 12*b* Grooves, 13 Engagement claw section, 14, 14*a* and 14*b* joints, 15 Driving machine, 16 Clamp, 17 Vibratory device, 18 Rear end of hat type steel sheet pile, 19 Forward end of hat type steel sheet pile, 20 Rear end of H-beam, 21 Forward end of H-beam, 22 Protruded Portion, 71 Joining surface of web of hat type steel sheet pile, A Separation length between rear end of hat type steel sheet pile and rear end of H-beam, B Separation length between forward end of hat type steel sheet pile and forward end of H-beam, C High-rigidity section of cross-section in which hat type steel sheet pile and H-beam are integrated, D Channel formed in hat type steel sheet pile by web and flanges

BEST MODE FOR CARRYING OUT THE INVENTION

The present invention is described in detail based on the embodiments shown in the drawings.

First, the basic form of a steel material for an underground continuous wall 1 used in the present invention is described with reference to FIG. 1A through FIG. 1D, and FIG. 2.

The steel material for an underground continuous wall 1 of the present invention combines a hat type steel sheet pile 2 with an H-beam 6 shorter than the hat type steel sheet pile 2 in the length direction, and adopts a special configuration in which the ends of the hat type steel sheet pile 2 coincide with or extend longitudinally outwardly past the corresponding ends of the H-beam 6 in the length direction. The hat type steel sheet pile 2 and the H-beam 6 are both rolled steel products produced by a hot rolling process.

Figure 4:
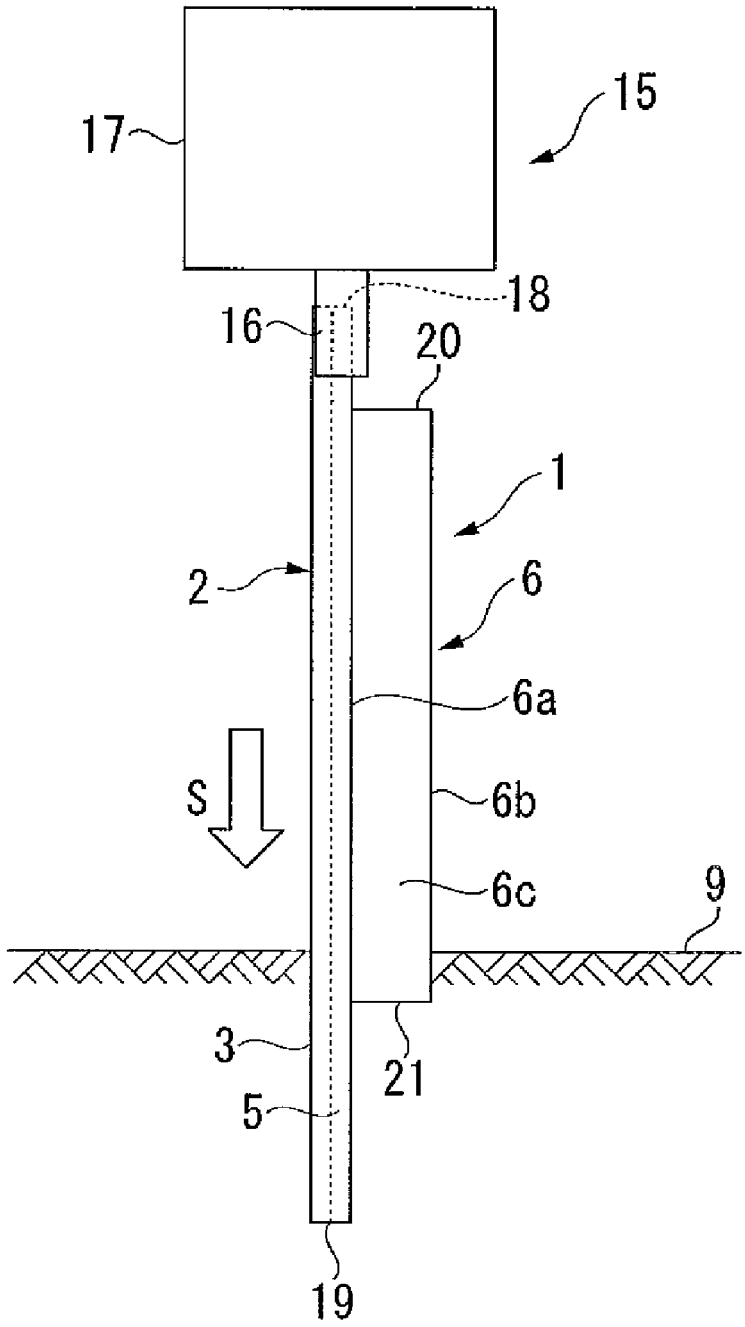
FIG. 4 is a figure showing a state in which a steel material for an underground continuous wall according to an aspect of the present invention is driven by a driving machine.

In the present invention, as shown in FIG. 4, when the steel material for an underground continuous wall 1 is driven into the ground to construct a retaining wall or bulkhead wall or the like, the top end of the steel material for an underground continuous wall 1 forming part of the retaining wall or bulkhead wall or the like is clamped by a driving machine 15 (including a clamp (clamping section) 16 and a vibratory device 17). Moreover, with the bottom end side of the steel material for an underground continuous wall 1 as the leading end and the top end side of the steel material for an underground continuous wall 1 as the tailing end, the steel material for an underground continuous wall 1 moves in the underground direction S, thereby driving the steel material for an underground continuous wall 1 underground. Accordingly, in the present invention, the forward end of the steel material for an underground continuous wall 1 is the bottom end when a retaining wall or bulkhead wall or the like is constructed from the steel material for an underground continuous wall 1, and the rear end of the steel material for an underground continuous wall 1 is the top end when a retaining wall or bulkhead wall or the like is constructed from the steel material for an underground continuous wall 1.

Figure 2:
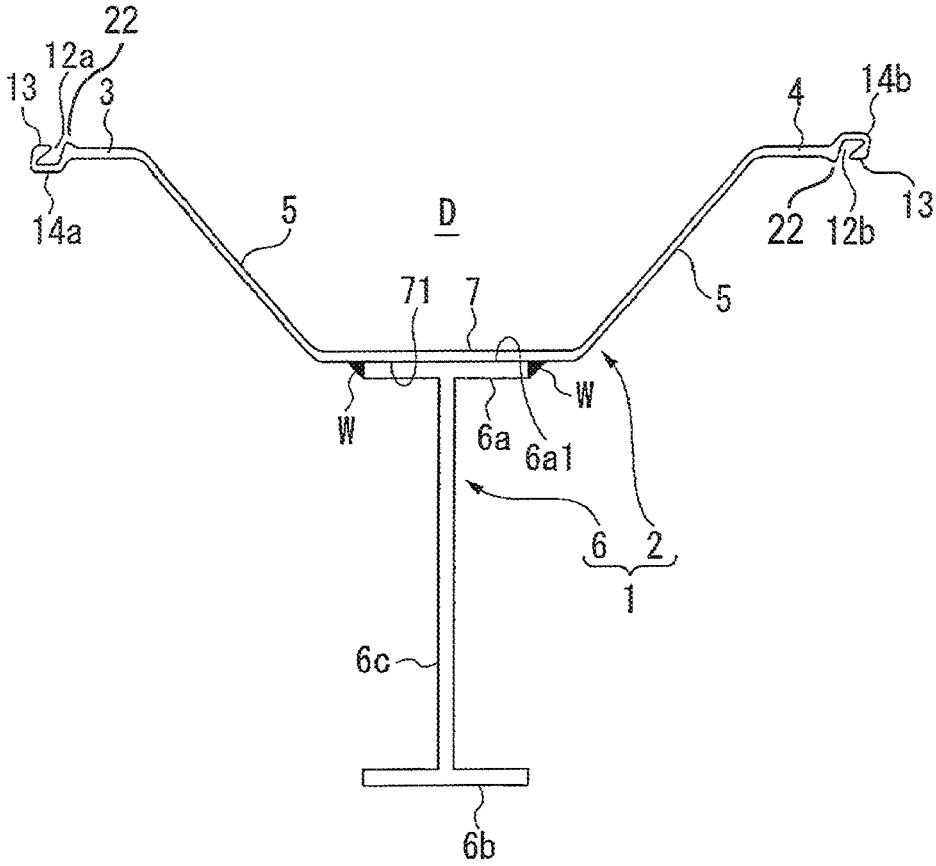
FIG. 2 is a plan view showing the rear end side of the steel material for an underground continuous wall according to an embodiment of the present invention.

Furthermore, as shown in FIG. 2, normally, a groove 12*a* in one joint 14*a* of the hat type steel sheet pile 2, and a groove 12*b* in the other joint 14*b* of the hat type steel sheet pile 2, each open on the opposite side to the other in the length direction of the steel material for an underground continuous wall 1 (the height direction of the retaining wall constructed using the steel material for an underground continuous wall 1). Consequently, when a plurality of steel materials for an underground continuous wall 1 are lined up along the longitudinal direction of the arm sections 3 and 4, the joints 14*a* and 14*b* of adjacent hat type steel sheet piles 2 are able to engage with each other. If, when constructing a retaining wall or the like from steel materials for an underground continuous wall 1, an attempt is made to install a steel material for an underground continuous wall 1 upside down, the joints 14*a* and 14*b* of the upside-down steel material for an underground continuous wall 1 do not engage with those of the adjacent steel materials for an underground continuous wall 1, and the plurality of steel materials for an underground continuous wall 1 cannot be connected to each other. For these and other reasons, during the construction stage of the underground continuous wall, the forward end and rear end of the steel material for an underground continuous wall 1 can be clearly ascertained.

Figure 1B:
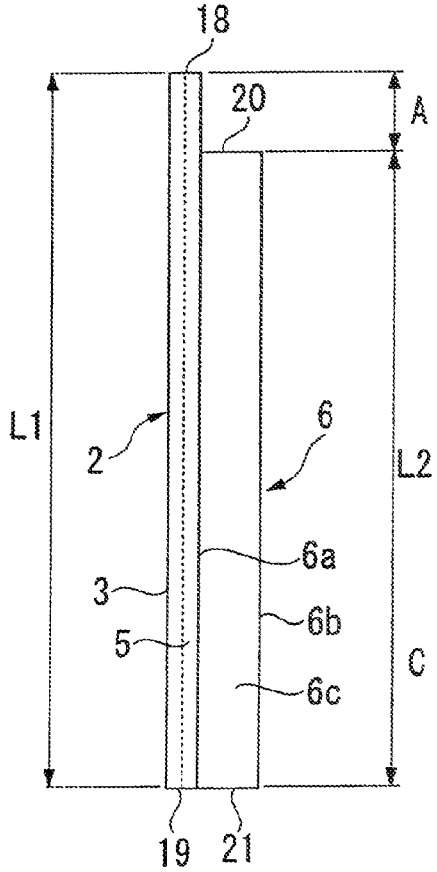
FIG. 1B is a side view of a steel material for an underground continuous wall according to a first aspect of the present invention.

In the steel material for an underground continuous wall 1 according to a first embodiment, as shown in FIG. 1B, in the length direction, the position of the forward end 19 of the hat type steel sheet pile 2 coincides with the position of the forward end 21 of the H-beam 6, and the position of the rear end 20 of the H-beam 6 is located closer to the forward end side than the position of the rear end 18 of the hat type steel sheet pile 2. In other words, this gives a steel material for an underground continuous wall 1 in which the rear end 20 side of the H-beam 6 is cut short. This steel material for an underground continuous wall 1, in transverse cross-section, is a steel material that includes both transverse cross-sections of a hat-shaped transverse cross-section composed only of the hat type steel sheet pile 2, and a composite cross-section composed of the hat type steel sheet pile 2 and the H-beam 6. More specifically, when the steel material for an underground continuous wall 1 is used as a wall material in a retaining wall, the dimensional difference (A) between the position of the rear end 18 of the hat type steel sheet pile 2 and the position of the rear end 20 of the H-beam 6 in the steel material for an underground continuous wall 1 is not more than 50% of a wall height H (refer to FIG. 5) from the planned ground level 10 to the ground surface 9 in a retaining wall 8 constructed from the steel material for an underground continuous wall 1, and the H-beam 6 is cut short by the equivalent of the dimensional difference (A).

In this embodiment, the relationship between the wall height H, the length dimension L1 of the hat type steel sheet pile 2, and the length dimension L2 of the H-beam 6 satisfies $H \times 0.50 \geqq (L1-L2)$. This (L1−L2) is the length A of the portion of the steel material for an underground continuous wall 1 at the rear end side which has a cross-section composed only of the hat type steel sheet pile 2.

Accordingly, in this embodiment, from partway along the steel material for an underground continuous wall 1 to the forward end side, a high rigidity section C of a cross-section in which the hat type steel sheet pile 2 and the H-beam 6 are integrated is formed. In the figure, reference symbol 6*a* indicates one flange section of the H-beam 6, reference symbol 6*b* indicates the other flange section of the H-beam 6, and reference symbol 6*c* indicates the web section of the H-beam 6.

Figure 1C:
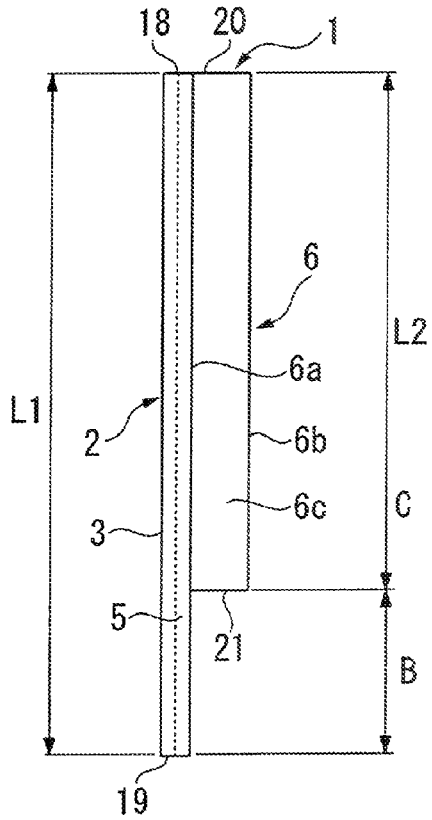
FIG. 1C is a side view of a steel material for an underground continuous wall according to a second aspect of the present invention.

Furthermore, in a second embodiment shown in FIG. 1A, FIG. 1C, and FIG. 2, the position of the rear end 18 of the hat type steel sheet pile 2 coincides with the position of the rear end 20 of the H-beam 6 in the length direction, and the forward end 21 of the H-beam 6 is located closer to the rear end side than the forward end 19 of the hat type steel sheet pile 2. In other words, in the steel material for an underground continuous wall 1, the forward end 21 side of the H-beam 6 is cut short. More specifically, the H-beam 6 is cut short so that in the steel material for an underground continuous wall 1, the dimensional difference (B) between the forward end 19 position of the hat type steel sheet pile 2 and the forward end 21 position of the H-beam 6 is not more than 35% of the overall length of the steel material for the underground continuous wall 1. Accordingly, in this embodiment, from partway along the steel material for an underground continuous wall 1 to the top side, a high rigidity section C with an integrated cross-section of the hat type steel sheet pile 2 and the H-beam 6 is formed.

In this embodiment, the relationship between the length dimension L1 of the hat type steel sheet pile 2 and the length dimension L2 of the H-beam 6 satisfies $L1 \times 0.35 \geqq (L1-L2)$. This (L1−L2) is the length B of the portion of the steel material for an underground continuous wall 1 at the front end side which has a cross-section composed only of the hat type steel sheet pile 2.

Figure 1D:
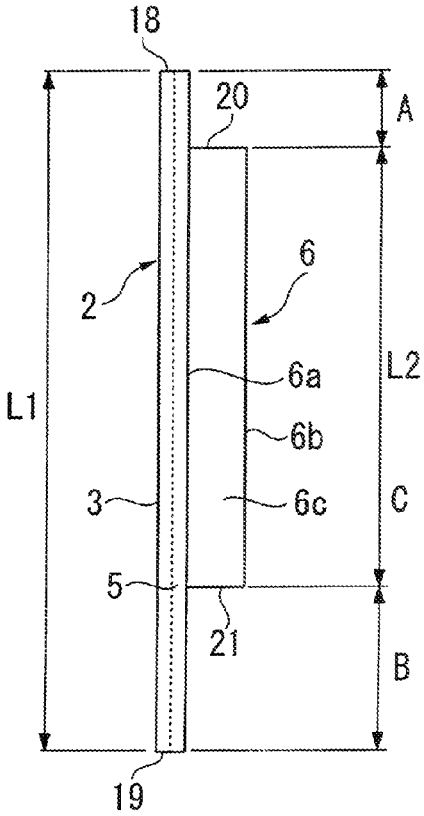
FIG. 1D is a side view of a steel material for an underground continuous wall according to a third aspect of the present invention.

In addition, in a third embodiment shown in FIG. 1A, FIG. 1D, and FIG. 2, the position of the rear end 20 of the H-beam 6 is located closer to the forward end side than the position of the rear end 18 of the hat type steel sheet pile 2, and the position of the forward end 21 of the H-beam 6 is located closer to the rear end side than the position of the forward end 19 of the hat type steel sheet pile 2. In other words, in the steel material for an underground continuous wall 1, the rear end 20 and the forward end 21 of the H-beam 6 are cut short. More specifically, the forward end 21 side of the H-beam 6 is cut short so that the dimensional difference (B) between the position of the forward end 19 of the hat type steel sheet pile 2 and the position of the forward end 21 of the H-beam 6 in the steel material for an underground continuous wall 1 is not more than 30% of the overall length of the steel material for an underground continuous wall 1. Furthermore, the rear end 20 side of the H-beam 6 is cut short so that the dimensional difference (A) between the position of the rear end 18 of the hat type steel sheet pile 2 and position of the rear end 20 of the H-beam 6 is not more than 50% of the wall height H. Accordingly, in this embodiment, a central portion not including the top and bottom ends of the steel material for an underground continuous wall 1 forms a high rigidity section C of a cross-section in which the hat type steel sheet pile 2 and one of the flanges 6*a* of the H-beam 6 are integrated.

In this embodiment, the relationship between the length dimension L1 of the hat type steel sheet pile 2 (the overall length of the steel material for an underground continuous wall 1), the length dimension L2 of the H-beam 6, the length A of the portion at the rear end side of the steel material for an underground continuous wall 1 with a cross-section composed only of the hat type steel sheet pile 2, and the length B of the portion at the forward end side of the steel material for an underground continuous wall 1 with a cross-section composed only of the hat type steel sheet pile 2, satisfies $A+B=L1-L2$, also satisfies $A \leqq H \times 0.50$, and further satisfies $B \leqq L1 \times 0.30$.

As described above, in the hat type steel sheet pile 2 of the respective embodiments, the joints 14*a* and 14*b* are integrally formed on the arm sections 3 and 4 at the end of the hat type steel sheet pile 2 manufactured by a hot rolling process. At the end of one of the arm sections 3 located on the upper left on the page, a groove-shaped joint 14*a* is provided which opens facing upward and includes a groove 12*a*, which opens towards the top of the drawing (upward on the page) in the opposite direction to the H-beam 6 side, and an engagement claw section 13. Moreover at the end of the other of the arm sections 4 located at the upper right on the page, a groove-shaped joint 14*b* is provided which opens facing downward and includes a groove 12*b*, which opens towards the bottom of the drawing (downward on the page) in the direction of the H-beam 6, and an engagement claw section 13.

Figure 5:
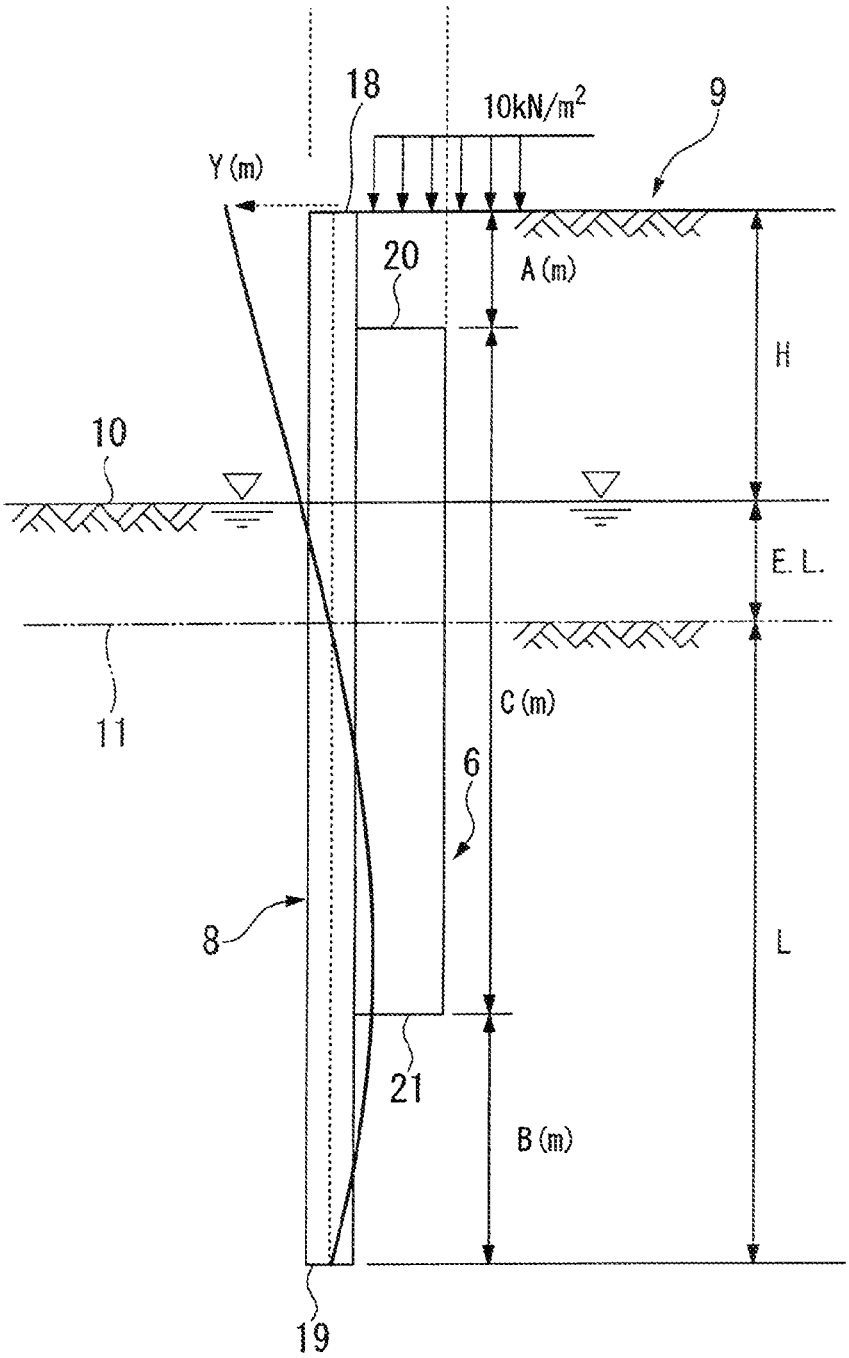
FIG. 5 is a longitudinal side view of a case where the steel material for an underground continuous wall of the embodiments of the present invention are used as a retaining wall, used to explain the relationship between the dimensions of the steel material for an underground continuous wall and crown displacement.

With regard to the first to third embodiments described above, whether or not a more economical steel material for an underground continuous wall 1 can be realized without encountering practical problems was investigated. Specifically, when constructing the retaining wall 8 as shown in FIG. 5, in order to suppress crown displacement (top end (rear end) displacement) of the steel material for an underground continuous wall 1 to not more than a 10% increase from the crown displacement Y (that is, not more than 110% of the crown displacement Y) designated by design for when a steel material for an underground continuous wall which includes a hat type steel sheet pile and an H-beam of equal lengths welded together along the entire length thereof is used, the dimensions of the steel material for an underground continuous wall 1 were considered as follows. For each embodiment, framed structural analysis was performed in which various N-values of ground and wall heights H were changed, and graphs of crown displacement as show in FIG. 6 to FIG. 9 were created.

The main dimensions in FIG. 5 are as follows:

(1) The wall height H is the height dimension from a planned ground level (the bottom surface after earth is excavated) 10 to a ground surface 9

(2) EL is the height dimension from a virtual ground level (in FIG. 5, the ground level at the height where the same earth pressure is applied to the steel material for an underground continuous wall 1 by the earth on the right side of the steel material for an underground continuous wall 1 and the earth on the left side of the steel material for an underground continuous wall 1) 11 to the planned ground level 10

(3) The penetration depth L is the height dimension from the virtual ground level 11 to the forward end 19 of the hat type steel sheet pile 2

Regarding the steel material for an underground continuous wall 1 of the first embodiment shown in FIG. 1B, more specifically, when used as a retaining wall 8 with the configuration shown in FIG. 5, in a case where a load of 10 kN/m$^2$ per unit area is applied to the ground surface 9, to what practical extent the length dimension of the rear end 20 side of the H-beam 6 can be cut with respect to the wall height H was investigated by the framed structural analysis. The obtained results are shown in FIG. 6.

In a case where a steel material for an underground continuous wall which includes a hat type steel sheet pile and an H-beam of equal lengths welded together along the entire length thereof (the conventional steel material for an underground continuous wall having the cross-section shown in FIG. 2 along the entire length) is used, the maximum value of the crown displacement is set at 0.05 m [50 mm]. For this reason, the ordinarily used conventional steel material for an underground continuous wall is designed to exhibit a crown displacement Y of not more than 40 mm to 45 mm. Accordingly, by designing the steel material for an underground continuous wall so that crown displacement is within a range not exceeding 10% more than the crown displacement Y (45 mm) designated in the design of the conventional steel material for an underground continuous wall, crown displacement is suppressed to not more than 50 mm. For this reason, the design of the steel material for an underground continuous wall is simplified, and there is no particular practical impediment to using such a steel material for an underground continuous wall as the retaining wall 8. Thus in the present invention, the crown displacement is set to not more than a 10% increase from the crown displacement Y [m] designated in the design of the conventional steel material for an underground continuous wall.

Figure 6:
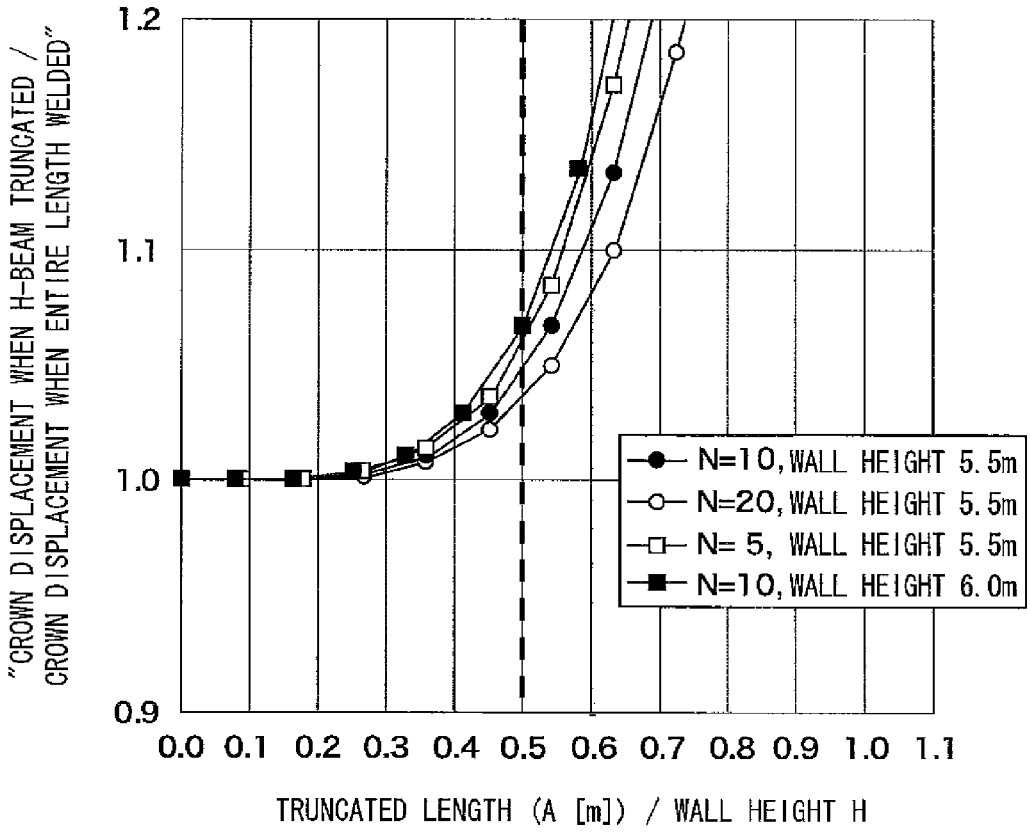
FIG. 6 is a diagram showing the relationship between the ratio between the cut length of the rear end of the H-beam and the wall height (truncated length A/wall height H) and crown displacement, for the case where the steel material for an underground continuous wall of the first embodiment of the present invention is used to construct a retaining wall.

In FIG. 6, the horizontal axis shows, in dimensionless form, the ratio (truncated length A [m]/wall height H [m]) between the cut length (truncated length A [m]) of the rear end 20 of the H-beam 6 and the wall height H [m]. The vertical axis shows, in dimensionless form, the ratio (crown displacement when H-steel truncated/crown displacement when entire length welded) between the crown displacement for a combination of an H-beam 6 with a cut rear end 20 side and a hat type steel sheet pile 2 (described in the graph as "crown displacement when H-steel truncated"), and the crown displacement for an H-beam 6 and hat type steel sheet pile 2 of equal length welded together along the entire lengths thereof (described in the graph as "crown displacement when entire length welded"), that is, increasing rate (nondimensional) of crown displacement. As shown by the relationship between the proportion of the cut dimension A [m] of the rear end 20 side of the H-beam, and the added proportion of crown displacement, in each case, in order to keep the added proportion of crown displacement to not more than 10%, as shown by the vertical dashed line, cutting can be performed to not more than 50% of the wall height H.

Furthermore it is apparent that if the separation length (A) between the rear end 18 of the hat type steel sheet pile 2 and the rear end 20 of the H-beam 6 exceeds 50% of the wall height H from the planned ground level 10 to the ground surface 9 in the retaining wall 8 constructed from the steel material for an underground continuous wall 1, crown displacement increases rapidly. In contrast, if the separation length (A) between the rear end 18 of the hat type steel sheet pile 2 and the rear end 20 of the H-beam 6 is not more than 50% of the wall height H from the planned ground level 10 to the ground surface 9 in the retaining wall 8 constructed from the steel material for an underground continuous wall 1, the rate of increase of crown displacement is kept low. In this manner, when the separation length (A) is not more than 50% of the wall height H, compared to when the separation length (A) exceeds 50% of the wall height H, the steel material for an underground continuous wall 1 is sufficiently rigid, and is also inexpensive and lightweight.

In addition, as shown in FIG. 6, if the rear end 20 side of the H-beam 6 is cut to not more than 30% of the wall height H, approximately the same crown displacement as when a steel material for an underground continuous wall including a hat type steel sheet pile and an H-beam of equal lengths welded together along the entire length thereof is used can be maintained, and a steel material for an underground continuous wall which has sufficient rigidity can be obtained.

Accordingly, the H-beam 6 can be cut to a length exceeding 0% of the wall height H but no more than 50% of the wall height H. For example, when cutting up to 10% of the wall height H from the H-beam 6, at a wall height H of 5.5 m, 0.55 m of the H-beam 6 can be cut, and at a wall height of 6.0 m, 0.6 m of the H-beam 6 can be cut, resulting in an inexpensive H-beam. When cutting up to 50% of the wall height H from the H-beam 6, at a wall height H of 5.5 m, 2.75 m of the H-beam 6 can be cut, and at a wall height of 6.0 m, 3.0 m of the H-beam 6 can be cut, which allows the use of a significantly less expensive H-beam 6 and results in an inexpensive steel material for an underground continuous wall 1. Furthermore, also apparent is that at not more than 30% of the wall height H, there is little variation in the added proportion of crown displacement, and a member is obtained which is similar to a steel material for an underground continuous wall in which the hat type steel sheet pile 2 and the H-beam 6 have the same length dimension.

Moreover, in the graphs of FIG. 6 described above and FIG. 7 to FIG. 9 described below, a case where the N-values of ground is 10 and the wall height H is 5.5 m is indicated by a black circle, a case where the N-values of ground is 20 and the wall height H is 5.5 m is indicated by a white circle, a case where the N-values of ground is 5 and the wall height H is 5.5 m is indicated by a white square, and case where the N-values of ground is 10 and the wall height H is 6.0 m is indicated by a black square.

Here, the N value is a value that indicates the hardness and compaction of the ground as determined by a standard penetration test, and refers to the number of blows, by a weight of a predetermined mass free-falling from a predetermined height, required for a sampler to penetrate the ground to a predetermined depth.

The expected result is that the larger the N value the smaller the crown displacement, and the higher the wall height H the larger the crown displacement, which is also apparent from the graphs.

Next, regarding the steel material for an underground continuous wall 1 of a second embodiment, in the same manner as for the first embodiment, framed structural analysis was performed to find the dimensions that keep crown displacement to not more than a 10% increase from the crown displacement Y [m]. The obtained results are shown in FIG. 7.

Figure 7:
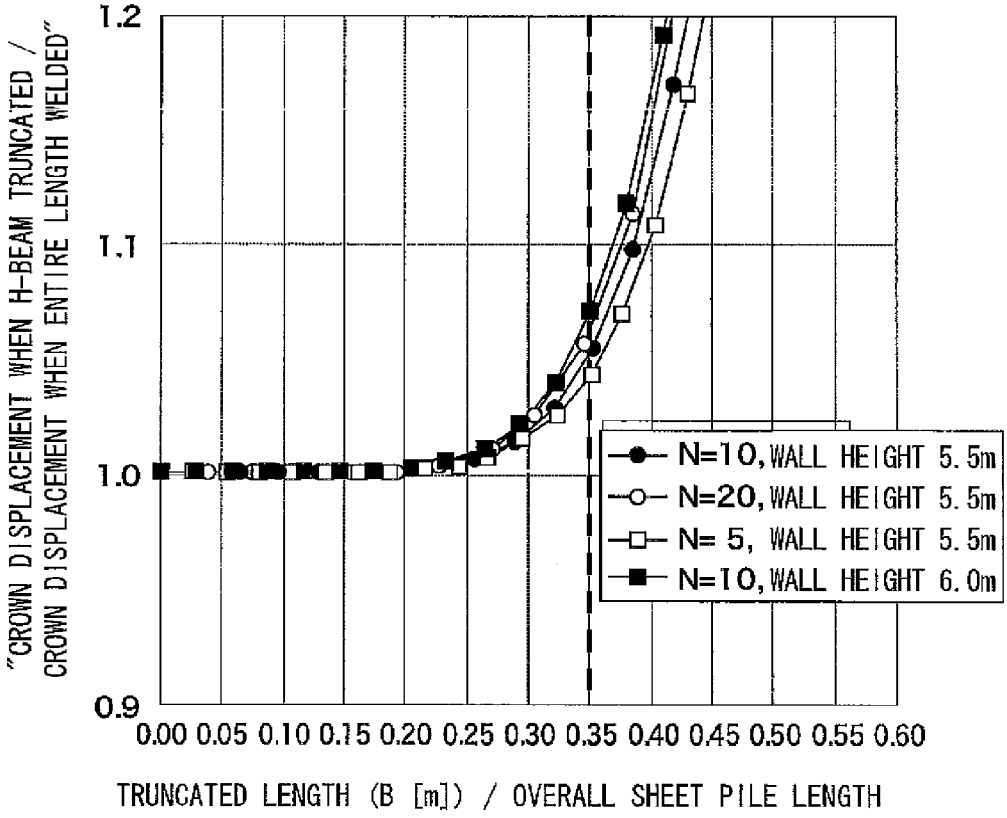
FIG. 7 is a figure showing the relationship between the ratio between the cut length of the rear end of the H-beam and the overall length of the hat type steel sheet pile (truncated length B/overall sheet pile length) and crown displacement, for the case where the steel material for an underground continuous wall of the second embodiment of the present invention is used to construct a retaining wall.

In FIG. 7, the horizontal axis shows, in dimensionless form, the ratio (truncated length B [m]/overall sheet pile length [m]) between the cut length (truncated length B [m]) of the forward end 21 of the H-beam 6 and the overall length [m] of the hat type steel sheet pile 2. The vertical axis shows, in dimensionless form, the ratio (crown displacement when H-steel truncated/crown displacement when entire length welded) between the crown displacement for a combination of an H-beam 6 with a cut forward end 21 side and a hat type steel sheet pile 2 (described in the graph as "crown displacement when H-steel truncated"), and the crown displacement for an H-beam 6 (uncut) and hat type steel sheet pile 2 of equal length welded together along the entire length thereof (described in the graph as "crown displacement when entire length welded"), that is, increasing rate (nondimensional) of crown displacement. As shown by the relationship between the proportion of the cut dimension B [m] of the forward end 21 side of the H-beam 6 with respect to the overall length, and the added proportion of crown displacement, in each case, in order to keep the added proportion of crown displacement to not more than 10%, as shown by the vertical dashed line, cutting can be performed to not more than 35% of the overall length of the hat type steel sheet pile 2.

Furthermore, it is apparent that if the separation length (B) between the forward end 19 of the hat type steel sheet pile 2 and the forward end 21 of the H-beam 6 exceeds 35% of the overall length in the length direction of the steel material for an underground continuous wall 1, crown displacement increases rapidly. In contrast, if the separation length (B) between the forward end 19 of the hat type steel sheet pile 2 and the forward end 21 of the H-beam 6 is not more than 35% of the overall length in the length direction of the steel material for an underground continuous wall 1, the rate of increase of crown displacement is kept low. In this manner, when the separation length is not more than 35% of the overall length, compared to when the separation length exceeds 35% of the overall length, the steel material for an underground continuous wall 1 is sufficiently rigid, and is also inexpensive and lightweight.

Accordingly, the H-beam 6 can be cut to a length exceeding 0% but not more than 35% of the overall length of the hat type steel sheet pile 2. Furthermore, also apparent is that at not more than 20% of the overall length of the hat type steel sheet pile 2, there is little variation in the added proportion of crown displacement, and a member is obtained which is similar to a steel material for an underground continuous wall in which the hat type steel sheet pile 2 and the H-beam 6 have the same length dimension.

Other aspects of the configuration are the same as for the previous embodiment.

Figure 8:
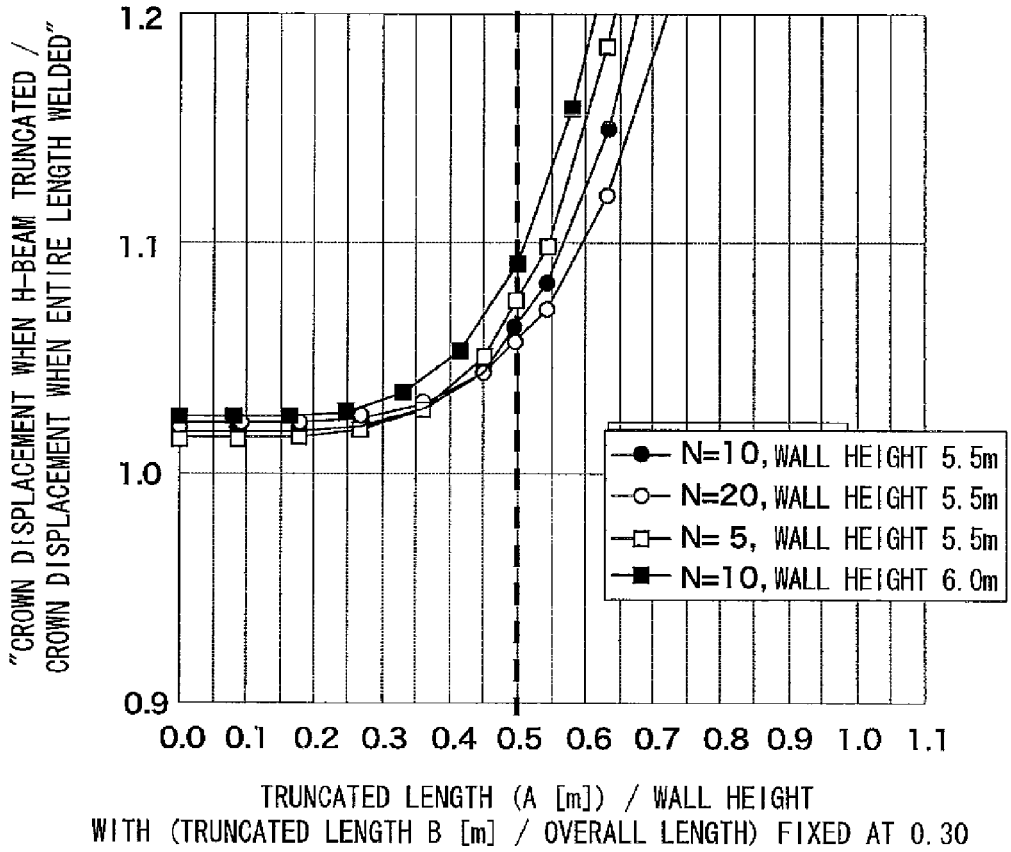
FIG. 8 is a figure showing the relationship between the ratio between the cut length of the rear end of the H-beam and the wall height (truncated length A/wall height H) and crown displacement when the location of the forward end is constant, for the case where the steel material for an underground continuous wall of the third embodiment of the present invention is used to construct a retaining wall.
Figure 9:
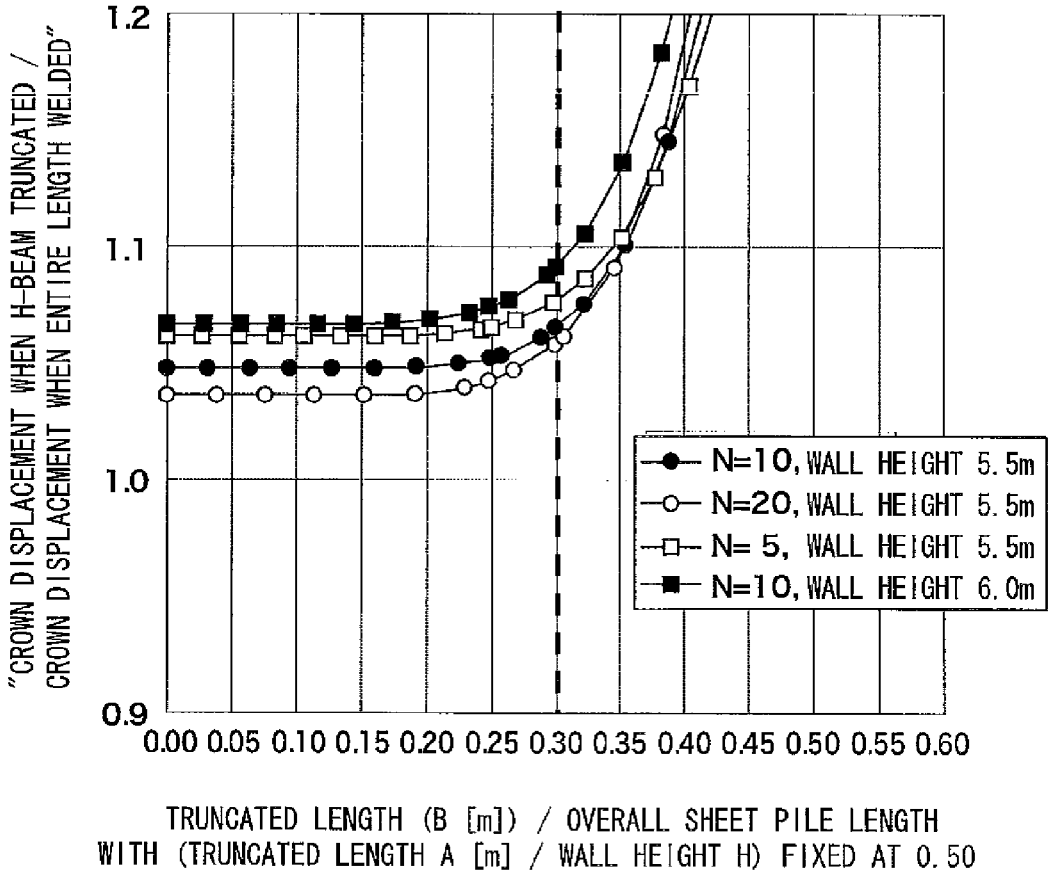
FIG. 9 is a figure showing the relationship between the ratio between the cut length of the front end of the H-beam and the overall length of the hat type steel sheet pile (truncated length B/overall sheet pile length) and crown displacement when the location of the rear end is constant, for the case where the steel material for an underground continuous wall of the third embodiment of the present invention is used to construct a retaining wall.
Figure 10:
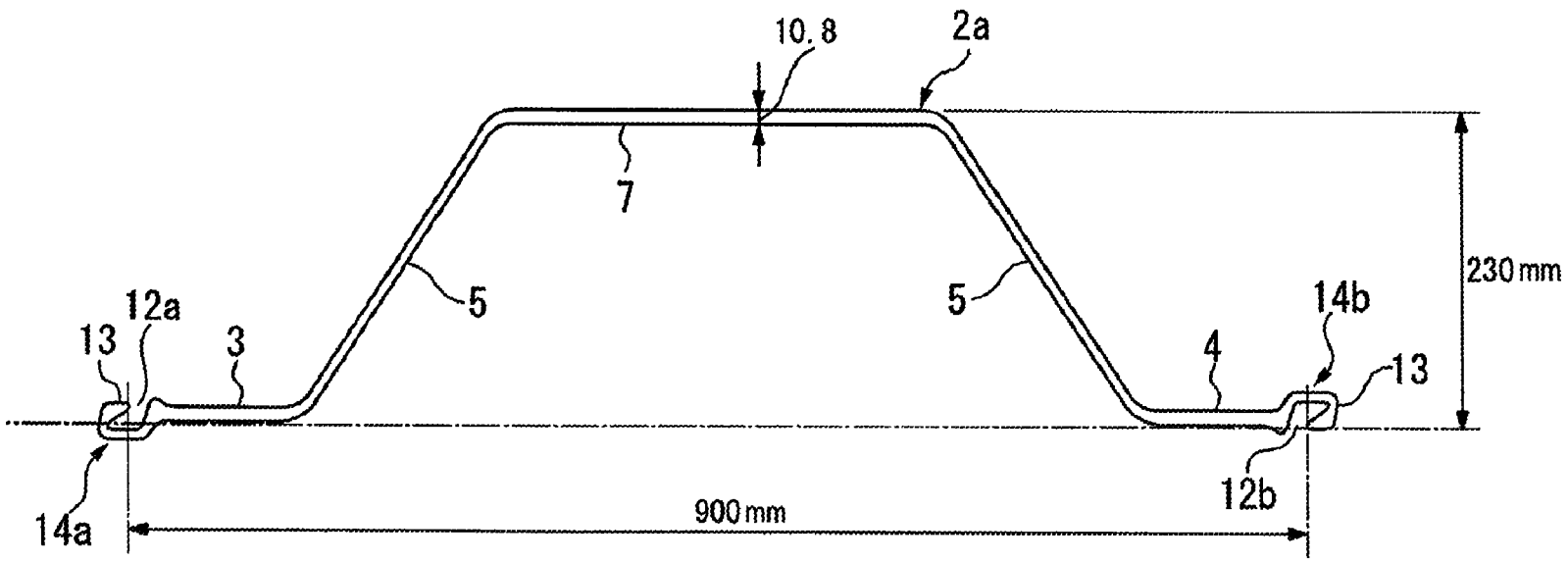
FIG. 10 PRIOR ART
FIG. 10 is a plan view showing an aspect of a conventional hat type steel sheet pile.
Figure 11:
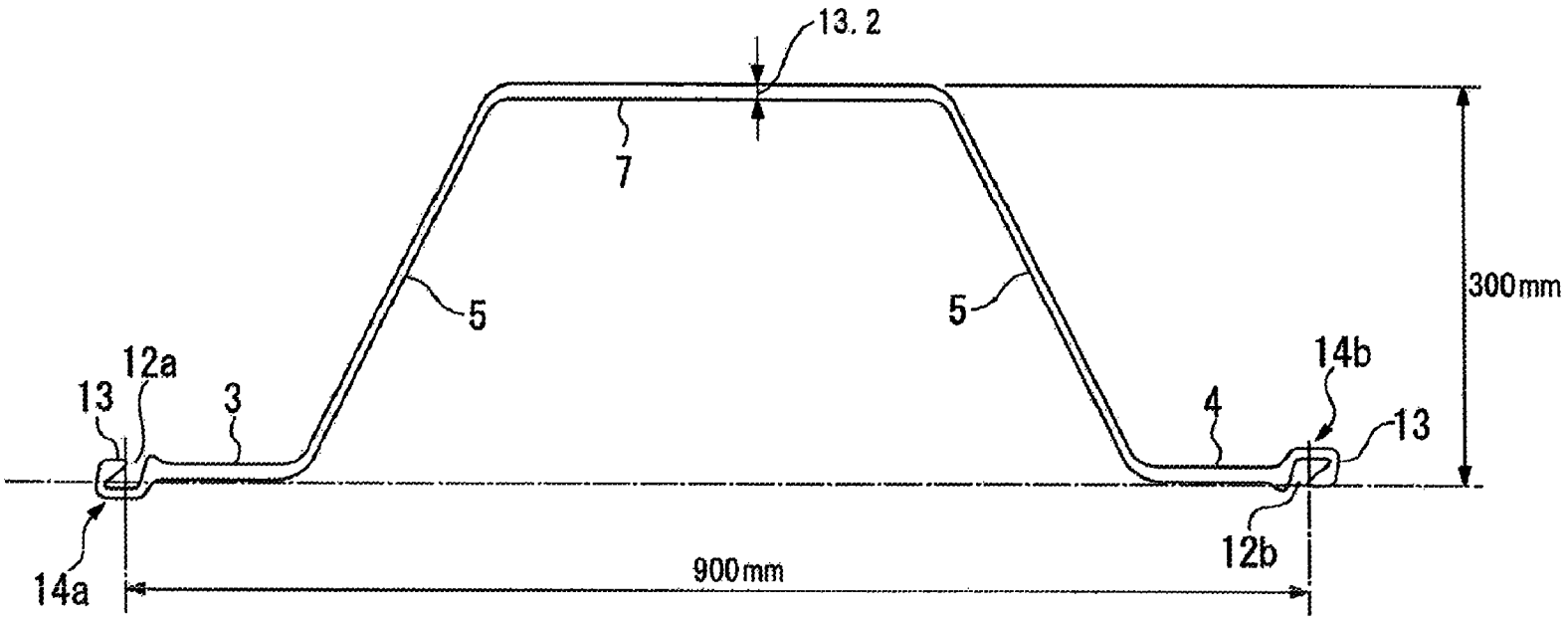
FIG. 11 PRIOR ART
FIG. 11 is a plan view showing another aspect of a conventional hat type steel sheet pile.

Next, regarding the steel material for an underground continuous wall 1 of a third embodiment, in the same manner as for the first embodiment, framed structural analysis was performed to find the specific dimensions (the proportion of the respective cut lengths of the rear end 20 side and forward end 21 side of the H-beam) that keep crown displacement to not more than a 10% increase from the crown displacement Y [m]. The obtained results are shown in FIG. 8 and FIG. 9. FIG. 8 shows the results for a case where the proportion of the cut length B [m] of the forward end 21 of the H-beam 6 is fixed, and the proportion of the cut length A [m] of the rear end 20 side is varied. FIG. 9 shows the results for a case where the proportion of the cut length A [m] of the rear end 20 side is fixed, and the proportion of the cut length B [m] of the forward end 21 of the H-beam 6 is varied. From these FIGS. 8 and 9, when cutting both the forward end 21 and the rear end 20 of the H-beam 6, feasible ratios of the cut length A [m] of the rear end 20 of the H-beam 6 with respect to the wall height H, and feasible ratios of the cut length B [m] of the forward end 21 of the H-beam 6 with respect to the overall length of the sheet pile are derived as follows.

Specifically, FIG. 8 shows the results of varying the cut length A [m] of the rear end 20 side of the H-beam 6, while the proportion of the cut length B [m] of the forward end 21 side of the H-beam 6 with respect to the steel material for an underground continuous wall (the overall sheet pile length of the hat type steel sheet pile 2) 1 remains fixed at 0.30, that is, with the cut length B [m] of the forward end 21 side of the H-beam 6 fixed at a constant value. From this FIG. 8, in order keep the crown displacement to not more than a 10% increase from the crown displacement Y, to what proportion the rear end 20 side of the H-beam 6 can be cut with respect to the wall height H is investigated. Because as the cut length A [m] of the rear end 20 side of the H-beam 6 decreases, naturally the rigidity of the steel material for an underground continuous wall 1 increases, and crown displacement is reduced, it is apparent that when the cut length A of the rear end 20 side exceeds 0% of the wall height H but does not exceed 50% as shown by the vertical dashed line, crown displacement can be kept to not more than a 10% increase from the crown displacement Y [m]. The vertical axis and horizontal axis are the same as in FIG. 6.

Furthermore, FIG. 9 shows the results of varying the cut length B [m] of the forward end 21 side of the H-beam 6, while the proportion of the cut length A [m] of the rear end 20 side of the H-beam 6 with respect to the wall height H remains fixed at 0.50, that is, with the cut length A [m] of the rear end 20 of the H-beam 6 fixed at a constant value. From this FIG. 9, in order keep the crown displacement to not more than a 10% increase, to what proportion the forward end 21 side of the H-beam 6 can be cut with respect to the overall length of the steel material for an underground continuous wall 1 is investigated. Because as the cut length B [m] of the forward end 21 side of the H-beam 6 decreases, naturally the rigidity of the steel material for an underground continuous wall 1 increases, and crown displacement is reduced, it is apparent that when the cut length B of the forward end 21 side exceeds 0% of the overall length of the steel material for an underground continuous wall 1 (hat type steel sheet pile 2) but does not exceed 30% as shown by the vertical dashed line, crown displacement can be kept to not more than a 10% increase from the crown displacement Y [m]. The vertical axis and horizontal axis are the same as in FIG. 7.

Moreover, as shown in FIG. 8 and FIG. 9, it is apparent that when the separation length (A) between the rear end 18 of the hat type steel sheet pile 2 and the rear end 20 of the H-beam 6 exceeds 50% of the wall height H from the planned ground level 10 to the ground surface 9 in the retaining wall 8 constructed from the steel material for an underground continuous wall 1, and the separation length (B) between the forward end 19 of the hat type steel sheet pile 2 and the forward end 21 of the H-beam 6 exceeds 30% of the overall length of the steel material for an underground continuous wall 1 in the length direction, crown displacement increases rapidly. In contrast, if the separation length (A) between the rear end 18 of the hat type steel sheet pile 2 and the rear end 20 of the H-beam 6 is not more than 50% of the wall height H from the planned ground level 10 to the ground surface 9 in the retaining wall 8 constructed from the steel material for an underground continuous wall 1, and the separation length (B) between the forward end 19 of the hat type steel sheet pile 2 and the forward end 21 of the H-beam 6 is not more than 30% of the overall length of the steel material for an underground continuous wall 1 in the length direction, the rate of increase of crown displacement is kept low. In this manner, in this case, compared to other cases, the steel material for an underground continuous wall 1 is sufficiently rigid, and is also inexpensive and lightweight.

When cutting the rear end 20 side of the H-beam 6, although any value exceeding 0% of the wall height H as described above offers economical advantages, at values close to 0% of the wall height H, the economical advantages are minimal. For this reason, for practical purposes, for example, a value of not less than 10% and not more than 50% of the wall height H is preferred. Furthermore, when cutting the forward end 21 side of the H-beam 6, although any value exceeding 0% of the overall length of the steel material for an underground continuous wall 1 as described above offers economical advantages, at cutting ratios close to 0% of the overall length of the steel material for an underground continuous wall 1, the economical advantages are minimal. For this reason, for example, for practical purposes, a value within a range from not less that 5% to not more than 35% of the overall length of the steel material for an underground continuous wall 1 is preferred. When cutting the forward end 21 side and the rear end 20 side of the H-beam 6, the cut to the rear end 20 side of the H-beam 6 is preferably set to not less than 10% and not more than 50% of the wall height H, and the cut to the forward end 21 side of the H-beam 6 is preferably set to within a range from not less that 5% to not more than 30% of the overall length of the steel material for an underground continuous wall 1.

Furthermore, normally, the length of the rear end section of the steel material for an underground continuous wall 1 which the setting machine clamps is not more than 500 mm. Accordingly, if the rear end 20 of the H-beam 6 is separated from the rear end 18 of the hat type steel sheet pile 2, the separation length (A) between the rear end 18 of the hat type steel sheet pile 2 and the rear end 20 of the H-beam 6 is preferably not less than 500 mM.

The method for producing the steel material for an underground continuous wall 1 of the present invention is as follows.

First the hat type steel sheet pile 2 and the H-beam 6 which form the steel material for an underground continuous wall 1 are prepared. The shape and dimensions of the hat type steel sheet pile 2 and the H-beam 6 are as described in the above embodiments. In the present invention, a hat type steel sheet pile 2 produced entirely by a hot rolling process can be used, or a hat type steel sheet pile 2 can be used in which the joints sections are produced by a hot rolling process and secured to the arm sections 3 and 4 by welding.

Figure 3A:
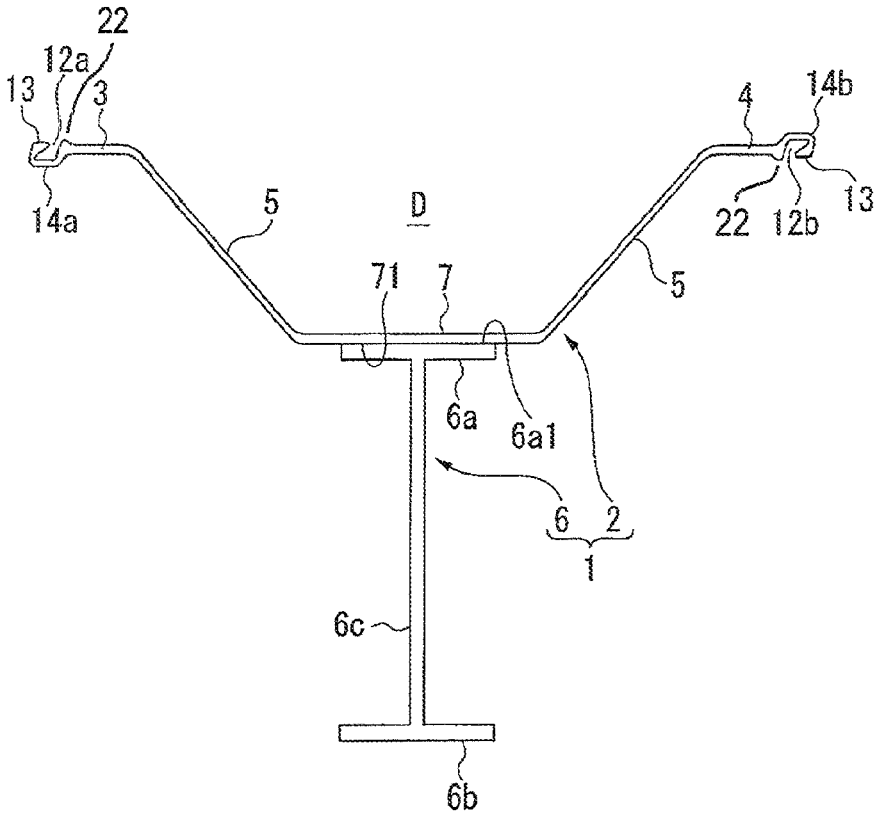
FIG. 3A is a figure showing a state in which a hat type steel sheet pile and an H-beam are in contact, in a method for producing a steel material for an underground continuous wall according to an embodiment of the present invention.

As shown in FIG. 3A, one of the flange sections 6*a* of the H-beam 6 is disposed on the opposite side to a channel D formed by the web 7 and flanges 5 of the hat type steel sheet pile 2, and the one flange section 6*a* of the H-beam 6 contacts the web 7 outside surface 71 of the hat type steel sheet pile 2. Here, the separation length (A) between the rear end 18 of the hat type steel sheet pile 2 and the rear end 20 of the H-beam 6, and the separation length (B) between the forward end 19 of the hat type steel sheet pile 2 and the forward end 21 of the H-beam 6 are adjusted appropriately to obtain the steel material for an underground continuous wall 1 of the embodiments described above.

Figure 3B:
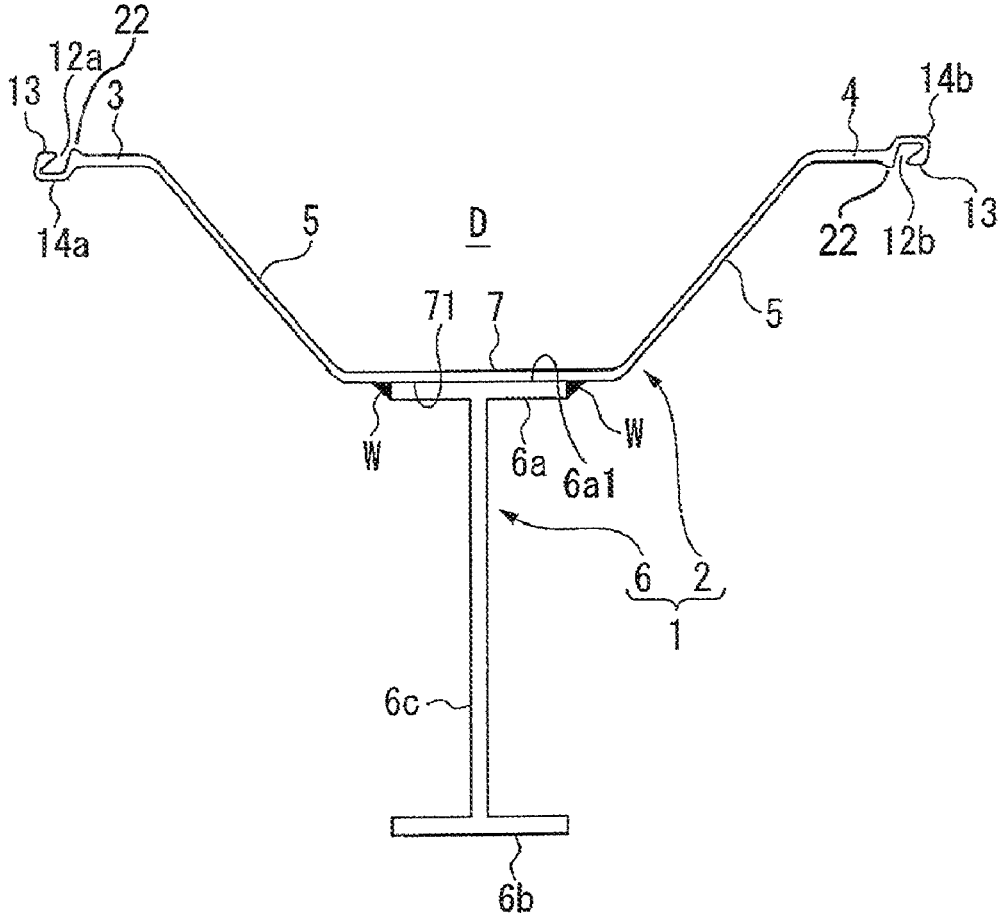
FIG. 3B is a figure showing a state in which a hat type steel sheet pile and an H-beam are joined by welding, in a method for producing a steel material for an underground continuous wall according to an embodiment of the present invention.

In this manner, in a state where the hat type steel sheet pile 2 and the H-beam 6 are in contact, as shown in FIG. 3B, both sides of the flange section 6*a* of the H-beam 6 are secured to the web 7 outside surface 71 (outer surface) side of the hat type steel sheet pile 2 along the entire length by a weld W.

The method for constructing the underground continuous wall of the present invention is shown below.

As shown in FIG. 4, in a state where the steel material for an underground continuous wall 1 of the present invention stands erect with the front end thereof facing the ground surface 9, the rear end section of the steel material for an underground continuous wall 1 is clamped by a clamp (clamping section) 16 of the driving machine 15. Although in FIG. 4 a situation is shown where the pair of flanges 5 of the hat type steel sheet pile 2 are each clamped by the clamp 16, alternatively only the web 7, or both the web 7 and the flanges 5, may be clamped.

Then, with the forward end side of the steel material for an underground continuous wall 1 as the leading end, the steel material for an underground continuous wall 1 is driven to a predetermined depth in the earthward direction S by the vibratory device 17.

Next, another steel material for an underground continuous wall 1 is prepared, and with the joint 14*a* of this steel material for an underground continuous wall 1 engaged with the joint 14*b* of the steel material for an underground continuous wall 1 which has already been driven, the other steel material for an underground continuous wall 1 is driven at the location where it is to be driven. Then, the pair of flanges 5 of the hat type steel sheet pile 2 are each clamped by the clamp 16 as described above, and the steel material for an underground continuous wall 1 is driven to a predetermined depth in the earthward direction S by the vibratory device 17.

These operations are repeated to drive a plurality of steel materials for an underground continuous wall 1 into the ground surface 9, thereby constructing the underground continuous wall of the present invention.

Moreover, to form the desired underground continuous wall, a plurality of steel materials for an underground continuous wall 1 may be driven in advance on the ground surface 9, the joints 14*a* and 14*b* engaged with those of the adjacent steel material for an underground continuous wall 1, and the steel materials for an underground continuous wall 1 sequentially driven in this state by the driving machine 15.

Furthermore, other steel materials for an underground continuous wall may be used together with the steel material for an underground continuous wall 1 of the present invention. For example, an underground continuous wall may be constructed by connecting the steel material for an underground continuous wall 1 with a steel material for an underground continuous wall composed only of a hat type steel sheet pile, in an alternating manner along the horizontal direction.

The invention claimed is:

1. An underground continuous wall structure comprising a plurality of steel materials, wherein each of the steel materials comprises a hat type steel sheet pile having a hat-shaped vertical cross-section with respect to a length direction thereof, and a single H-beam having an H-shaped vertical cross-section with respect to a length direction thereof;

the hat type steel sheet pile comprises a single web, a pair of flanges connected integrally to each end of the single web and inclined so as to spread outward, and a pair of arm sections substantially parallel to the single web which are each connected integrally to one of the pair of flanges;

the single H-beam comprises a pair of flange sections substantially parallel to each other, and a web section which connects the pair of flange sections to each other leaving space therebetween;

an outer surface of one of the pair of the flange sections of the single H-beam on an opposite side to a surface of the one of the pair of flange sections of the single H-beam which connects to the web section is secured by welding to an outer surface of the single web of the hat type steel sheet pile, the outer surface of the single web of the hat type steel sheet pile being on an opposite side to a channel formed by the single web and the flanges of the hat type steel sheet pile;

a longitudinal length of the single H-beam is shorter than a longitudinal length of the hat type steel sheet pile;

a rear end of the single H-beam is located closer to a forward end side in the length direction of the hat type steel sheet pile than a rear end of the hat type steel sheet pile;

a forward end of the single H-beam is located closer to a rear end side than a forward end of the hat type steel sheet pile in the length direction;

a separation length between the for forward end of the hat type steel sheet pile and the forward end of the single H-beam is not less than 5% and not more than 30% of an overall length of each of the steel materials in the length direction of the hat type steel sheet pile;

a joint is formed in a first end of each of the pair of the arm sections on an opposite side to a second end of each of the pair of the arm sections which is connected integrally to each of the pair of flanges, the joint including an engagement claw section;

a groove is formed in the joint so that the engagement claw section is located at the first end, and a shape of the groove is substantially the same as a shape of the engagement claw section in the hat-shaped vertical cross-section;

the plurality of the steel materials is disposed so that a separation length between the rear end of the hat type steel sheet pile and the rear end of the single H-beam is not less than 10% and not more than 50% of a wall height from a planned ground level to a ground surface in the underground continuous wall structure; and the forward end of the single H-beam of each of the steel materials is disposed in a ground.

2. An underground continuous wall structure comprising a plurality of steel materials, wherein each of the steel materials comprises a hat type steel sheet pile having a hat-shaped vertical cross-section with respect to a length direction thereof, and a single H-beam having an H-shaped vertical cross-section with respect to a length direction thereof;

the hat type steel sheet pile comprises a single web, a pair of flanges connected integrally to each end of the single web and inclined so as to spread outward, and a pair of arm sections substantially parallel to the single web which are each connected integrally to one of the pair of flanges;

the single H-beam comprises a pair of flange sections substantially parallel to each other, and a web section which connects the pair of flange sections to each other leaving space therebetween;

an outer surface of one of the pair of the flange sections of the single H-beam on an opposite side to a surface of the one of the pair of flange sections of the single H-beam which connects to the web section is secured by welding to an outer surface of the single web of the hat type steel sheet pile, the outer surface of the single web of the hat type steel sheet pile being on an opposite side to a channel formed by the single web and the flanges of the hat type steel sheet pile;

a longitudinal length of the single H-beam is shorter than a longitudinal length of the hat type steel sheet pile;

a rear end of the single H-beam is located closer to a forward end side in the length direction of the hart type steel sheet pile than a rear end of the hat type steel sheet pile;

a forward end of the single H-beam is located closer to a rear end side than a forward end of the hat type steel sheet pile in the length direction;

a separation length between the forward end of the hat type steel sheet pile and the forward end of the single H-beam is not less than 5% and not more than 30% of an overall length of each of the steel materials in the length direction of the hat type steel sheet pile;

the plurality of the steel materials is disposed so that a separation length between the rear end of the hat type steel sheet pile and the rear end of the single H-beam is not less than 10% and not more than 50% of a wall height from a planned ground level to a ground surface in the underground continuous wail structure; and the forward end of the single H-beam of each of the steel materials is disposed in a ground.

3. The underground continuous wall structure according to claim 1 or 2, wherein the separation length between the rear end of the hat type steel sheet pile and the rear end of the single H-beam is not less than 500 mm.

4. The underground continuous wall structure according to claim 1 or 2, wherein a whole of the single H-beam of each of the steel materials is disposed in the ground.

5. The underground continuous wall structure according to claim 1 or 2, wherein, a portion of the outer surface of the single web of the hat type steel sheet pile between the rear end of the hat type steel sheet pile and a position at which the rear end of the single H-beam contacts the outer surface of the single web of the hat type steel sheet pile contacts the ground, and an end face of the rear end of the hat type steel sheet pile is substantially continuous with the ground surface.

6. The underground continuous wall structure according to claim 1, wherein an opened direction of the groove of one of the pair of the arm sections is opposite to an opened direction of the groove of the other of the pair of the arm sections in the hat-shaped vertical cross-section.

7. The underground continuous wall structure according to claim 1, wherein in each of the steel materials, a protruded portion is formed in the joint on an opened side of the groove in the hat-shaped vertical cross-section so as to connect to a surface of the groove on an opposite side of the engagement claw section of an adjacent steel material.

8. The underground continuous wall structure according to claim 1, wherein a surface of the engagement claw section on an opened side of the groove is located in substantially a same line as a surface of the arm section on the opened side of the groove in the hat-shaped vertical cross-section.

9. The underground continuous wall structure according to claim 1 or 2, wherein a weld by the welding is formed along the entire length of the single H-beam in the length direction of the single H-beam on both sides of the one of the pair of the flange section of the single H-beam.

10. A method for constructing an underground continuous wall structure, the method comprising, constructing the underground continuous wall structure by disposing a plurality of steel materials so that a separation length between a rear end of a hat type steel sheet pile and a rear end of a single H-beam is not less than 10% and not more than 50% all height from a planned ground level to a ground surface in the underground continuous wall structure and a forward end of the single H-beam of each of the steel materials is disposed in a ground, wherein each of the steel materials comprises the hat type steel sheet pile having a hat-shaped vertical cross-section with respect to a length direction thereof, and the single H-beam having an H-shaped vertical cross-section with respect to a length direction thereof;

the hat type steel sheet pile comprises a single web, a pair of flanges connected integrally to each end of the single web and inclined so as to spread outward, and a pair of arm sections substantially parallel to the single web which are each connected integrally to one of the pair of flanges;

the single H-beam comprises a pair of flange sections substantially parallel to each other, and a web section which connects the pair of flange sections to each other leaving space therebetween;

an outer surface of one of the pair of the flange sections of the single H-beam on an opposite side to a surface of the one of the pair of flange sections of the single H-beam which connects to the web section is secured by welding to an outer surface of the single web of the hat type steel sheet pile, the outer surface of the single web of the hat type steel sheet pile being on an opposite side to channel formed by the single web and the flanges of the hat type steel sheet pile;

a longitudinal length of the single H-beam is shorter than a longitudinal length of the hat type steel sheet pile;

the rear end of the single H-beam is located closer to a forward end side in the direction of the hat type steel sheet pile than the rear end of the hat type steel sheet pile;

the forward end of the single H-beam is located closer to a rear end side than a forward end of the hat type steel sheet pile in the length direction; and a separation length between the forward end of the hat type steel sheet pile and the forward end of the single H-beam is not less than 5% and not more than 30% of an overall length of each of the steel materials in the length direction of the hat type steel sheet pile.

11. The method for constructing an underground continuous wall structure according to claim 10, wherein a joint is formed in a first end of each of the pair of the arm sections on an opposite side to a second end of each of the pair of the arm sections which is connected integrally to each of the pair of flanges, the joint including an engagement claw section; and a groove is formed in the joint so that the engagement claw section is locate at the first end, and a shape of the groove is substantially the same as a shape of the engagement claw section in the hat-shaped vertical cross-section.

* * * * *